US008509645B2

(12) United States Patent
Ikegami et al.

(10) Patent No.: US 8,509,645 B2
(45) Date of Patent: Aug. 13, 2013

(54) IMAGE FORMING SYSTEM AND APPARATUS WITH DIFFERENT PRINTING MODES FOR DIFFERENT NUMBERS OF PRINTING SHEETS

(75) Inventors: Shoichiro Ikegami, Yokohama (JP); Tohru Saito, Mishima (JP); Shinji Hashiguchi, Mishima (JP); Masato Sako, Suntou-gun (JP); Takehiko Suzuki, Yokohama (JP); Jun Asami, Susono (JP)

(73) Assignee: Canon Kabushiki Kaisha, Tokyo (JP)

( * ) Notice: Subject to any disclaimer, the term of this patent is extended or adjusted under 35 U.S.C. 154(b) by 31 days.

(21) Appl. No.: 13/248,262

(22) Filed: Sep. 29, 2011

(65) Prior Publication Data

US 2012/0033987 A1 Feb. 9, 2012

Related U.S. Application Data

(63) Continuation of application No. PCT/JP2010/056129, filed on Mar. 30, 2010.

(30) Foreign Application Priority Data

Mar. 30, 2009 (JP) ..... 2009-082562
Jul. 30, 2009 (JP) ..... 2009-178091

(51) Int. Cl.
*G03G 15/00* (2006.01)

(52) U.S. Cl.
USPC ..... 399/82

(58) Field of Classification Search
USPC ..... 399/82, 45, 69
See application file for complete search history.

(56) References Cited

U.S. PATENT DOCUMENTS 4,145,599 A * 3/1979 Sakurai et al.
4,607,945 A * 8/1986 Ide et al.
6,151,462 A 11/2000 Fukuzawa et al.
6,999,692 B2 2/2006 Shimura et al.

(Continued)

FOREIGN PATENT DOCUMENTS

JP 63-313182 12/1988
JP 2-157878 6/1990

(Continued)

OTHER PUBLICATIONS

International Search Report mailed Apr. 27, 2010, in International Patent Application No. PCT/JP2010/056129.

*Primary Examiner* — Susan Lee
(74) *Attorney, Agent, or Firm* — Fitzpatrick, Cella, Harper & Scinto

(57) ABSTRACT

An image forming system includes an image forming apparatus including a heating fixing portion and a host computer capable of instructing printing. In the image forming apparatus, throughput can be changed and discriminated in accordance with a printing number. For printing on small size sheets, the system is operable in a normal small size sheet mode and in a high speed small size sheet output mode, in which the printing is effected at a throughput which is higher than that in the normal small size sheet mode and, after completion of the printing, the image forming apparatus rests for a predetermined rest period. The host computer includes a mode selector for selecting a mode from the high speed small size sheet output mode and the normal small size sheet mode, and a controller for transmitting the mode selected by the mode selector to the image forming apparatus.

7 Claims, 16 Drawing Sheets

(56) References Cited

U.S. PATENT DOCUMENTS

| | | | |
|---|---|---|---|
| 7,501,777 | B2 * | 3/2009 | Yun et al. |
| 2003/0206756 | A1 * | 11/2003 | Kanamori et al. |
| 2004/0042825 | A1 * | 3/2004 | Yasui et al. |
| 2006/0020365 | A1 * | 1/2006 | Takeda |
| 2007/0247651 | A1 * | 10/2007 | Maehira |

FOREIGN PATENT DOCUMENTS

| | | | | |
|---|---|---|---|---|
| JP | 4-44075 | | | 2/1992 |
| JP | 4-204980 | | | 7/1992 |
| JP | 5-142910 | | | 6/1993 |
| JP | 7-199694 | | | 8/1995 |
| JP | 11-24493 | | | 1/1999 |
| JP | 11-73055 | | | 3/1999 |
| JP | 11-258943 | | | 9/1999 |
| JP | 2001356647 | A | * | 12/2001 |
| JP | 2003-50519 | | | 2/2003 |
| JP | 2006-84805 | | | 3/2006 |
| JP | 2006154061 | A | * | 6/2006 |

* cited by examiner (a)

(b)

(a)

(b)

| | SMALL SIZE SHEET JOB NO. (LTR, LONGITUDINAL) | | | | | | | | S.W. NO. |
|---|---|---|---|---|---|---|---|---|---|
| | 14 | | 30 | | 100 | | 200 | | |
| | AVE. PPM | I.F. SPD | AVE. PPM | I.F. SPD | AVE. PPM | I.F. SPD | AVE. PPM | I.F. SPD | |
| EMB. 1 | 20ppm | 1ST SPD | 13.4ppm | 1ST SPD | 13.4ppm | 2ND SPD | 13.4ppm | 2ND SPD | 30 |
| CMP. 1 | 13.4ppm | 2ND SPD | 13.4ppm | 2ND SPD | 13.4ppm | 2ND SPD | 13.4ppm | 2ND SPD | NO. |
| CMP. 2 | 20ppm | 1ST SPD | 13.4ppm | 1ST SPD | 10.7ppm | 1ST SPD | 9.5ppm | 1ST SPD | NO. |

(C)

IMAGE FORMING SYSTEM AND APPARATUS WITH DIFFERENT PRINTING MODES FOR DIFFERENT NUMBERS OF PRINTING SHEETS

FIELD OF THE INVENTION

The present invention relates to an image forming system and an image forming apparatus comprising host computer and an image forming apparatus, and more particularly to an improvement in a throughput of small size sheet printing.

BACKGROUND ART

Conventionally, in a heat-fixing device (fixing device) provided in a image forming apparatus employing a electrophotographic system or an electrostatic recording system, a so-called heating roller type fixing device is widely used. In the fixing device, a recording material carrying the unfixed toner image is passed through a nip provided between a fixing roller and a pressing roller which are press-contacted to each other and are rotated by which the toner image is fixed on the recording material as a permanent image.

On the other hand, a film heating type fixing device has been put into practice, in which no electric power is supplied to the fixing device during a stand-by period, by which the electric energy consumption is minimized. Such a film heating type fixing device proposed and put to practical use as disclosed in Japanese Laid-open Patent Application Sho 63-313182, Japanese Laid-open Patent Application Hei 2-157878, Japanese Laid-open Patent Application Hei 4-44075 and Japanese Laid-open Patent Application Hei 4-204980, for example.

FIG. 2 shows a typical film heating type fixing device. A fixing nip N is formed by a heater 204, a pressing roller 202 supported by a heat-insulative holder 205 and a resin or metal fixing film 203 (fixing film) having a high heat conduction and sandwiched therebetween. The unfixed toner image formed and carried on the recording material is introduced into the fixing nip N and is heated and fixed. In order to provide a sufficient width N of the fixing nip to form a satisfactory fixed image, the fixing members including a heater 204 and a fixing film 203 are urged to the pressing roller 202 by an urging spring 206 or the like against the elastic of the pressing roller 202 In order to stably provide the fixing nip width N which is substantially uniform along the longitudinal direction of the fixing member, a pressure substantially uniform along the longitudinal direction of the heat-insulative holder 205 is applied through a metal stay 207 having a reverse U shape In addition, a structure in which a core metal at a end of the pressing roller is provided with a electroconductive rubber ring 209 such that the film potential is stabilized, is put into practice.

Recently, however, there are demands in an image forming apparatus such as a copying machine or a printer, toward a high printing speed, quick start, power save or downsizing. Because of the speed up of parts, the fixing temperature rises, and in order to accomplish the quick start, the improvement in the thermal responsivity of the heater and the reduction of the low thermal capacity thereof are intended. As a result, the temperature difference becomes large between the area in the fixing nip where the recording material exists (sheet passing area) and where the heat of the fixing device is deprived by the recording material and the area where the recording material does not exist (non-sheet-passage-part) and where the heat is not deprived. Therefore, when a recording material (small size sheet) having a relatively small width as compared with the length of the fixing device is fed into the fixing device, the temperature difference in the fixing device along the longitudinal direction is large.

This means that a temperature difference between the proper fixing temperature for the recording material and the destruction temperature of the fixing device, that is, the margin is small. At present, in order to reduce the temperature difference, as compared with the case in which a relatively large recording material (full size sheet) is processed, when a small size sheet is processed, the printing speed is lowered (throughput down) to provide a time period for reducing the temperature unevenness, in many examples. In the actual situations, limited numbers of sheets are processed randomly, but in conventional devices, the setting of the throughput down is determined supposing that a large amount of the small size sheets are continuously outputted. The result is that for the actual use of the device, the margin against destruction is relatively large. Thus, in the case of outputting small size sheets, the throughput down as compared with the case of the large size sheets is significantly large, which is not desirable for the users.

Prior art solving this problem proposes that a plurality of heat generating elements having different lengths are prepared, and the different heat generating elements are used correspondingly to the different lengths of the recording material. An example of such a structure is disclosed in Japanese Laid-open Patent Application 2006-84805. However, with this structure, the problems of complicated structure of the device and the resulting cost increase arise, and therefore, it is difficult to employ it in a low cost machine.

DISCLOSURE OF INVENTION

The present invention is made under the circumstances, and an object thereof is to increase the small size sheet throughput at a low cost, thus improving the operability.

According to an aspect of the present invention, there is provided an image forming system comprising an image forming apparatus including a heating fixing portion and a host computer capable of instructing printing to said image forming apparatus, wherein for the printing on a small size sheet having a width smaller than a maximum processible width of said image forming apparatus, said system is operable in a normal small size sheet mode, and in a high speed small size sheet output mode in which the printing is effected at a throughput which is higher than in the normal small size sheet mode, and after completion of the printing, the image forming apparatus rests for a predetermined rest period, wherein said host computer includes a mode selector for selecting a mode from the high speed small size sheet output mode and the normal small size sheet mode, and a controller for transmitting the mode selected by said mode selector to said image forming apparatus.

These and other objects, features and advantages of the present invention will become more apparent upon a consideration of the following description of the preferred embodiments of the present invention taken in conjunction with the accompanying drawings.

PREFERRED EMBODIMENTS OF THE INVENTION

An embodiment of the present invention in the form of an image forming system will be described in detail.

Embodiment 1

The image forming system according to Embodiment 1 will be described.

Figure 1:
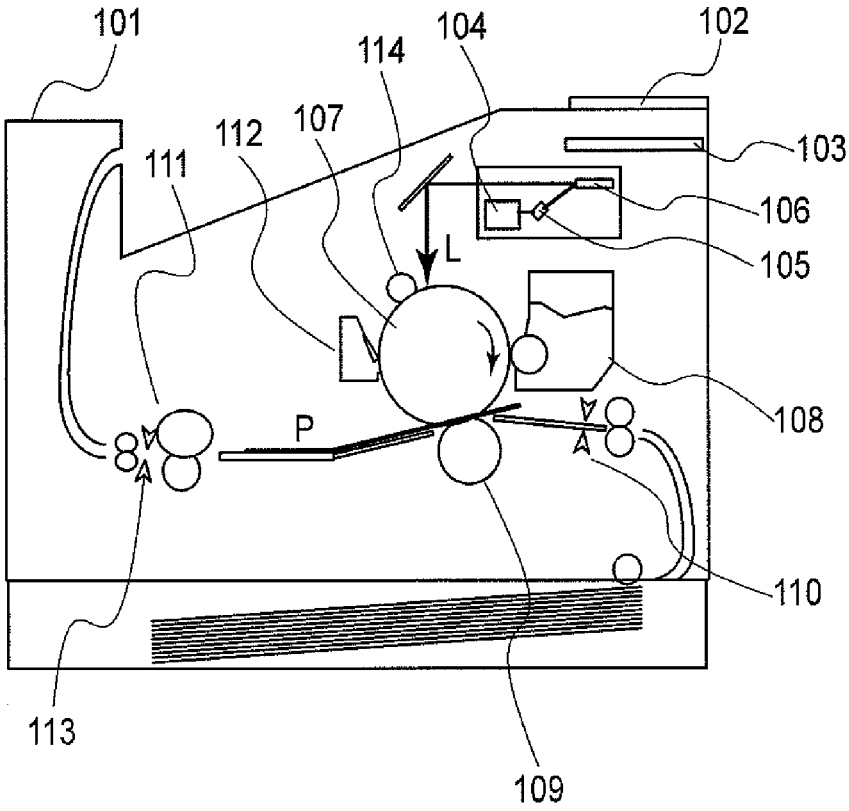
FIG. 1 is a sectional view schematically showing an image forming apparatus used with Embodiment 1.

Referring to FIG. 1, the description will be made as to a laser beam printer (LBP) which is an image forming apparatus used in the image forming system according to this embodiment.

Here, the image forming apparatus is not limited to a LBP, but may be a copying machine, facsimile machine or the like.

FIG. 1 is a schematic sectional view illustrating a structure of the image forming apparatus communicatable with an information processing apparatus.

In FIG. 1, designated by 101 is a main assembly of the LBP, which receives print data (including character codes, image data or the like), printing information comprising control codes, macro instructions or the like which are supplied from a host computer or the like connected to an external device, and which stores them. And, it makes character patterns, form patterns or the like in accordance with the information to form an image on a recording material.

Designated by 102 is an operation panel including switches for operation and LED displaying device or the like. Designated by 103 is a printing controller for controlling the main assembly 101 of the LBP and for analyzing the letter information or the like supplied from the host computer to effect the printing process. The printing information loaded in the printing controller 103 is converted to a pattern video signal and is supplied to a laser driver 104. The laser driver 104 includes a circuit for driving the semiconductor laser 105, and on-off-controls a laser beam L emitted by a semiconductor laser 105 in accordance with video signals inputted thereto. The laser beam L is deflected by a rotatable polygonal mirror 106 in the left-light directions to scanningly expose the photosensitive drum 107 which has been uniformly charged by a charging device 114.

By this, an electrostatic latent image corresponding to the image pattern is formed on the photosensitive drum 107. The latent image is developed and visualized by a developing device 108 provided adjacent the photosensitive drum 107. As for the usable developing methods, there are a jumping developing method, a two-component developing method, FEED developing method, and a combination of the image exposure and the reverse development is frequently used.

The visualized toner image is transferred from the photosensitive drum 107 onto a recording material P fed at a predetermined timing, by a transfer roller 109 as a transferring device. In order to align the leading end of the image on the recording material with the image formation position of the toner image on the photosensitive drum 107, the leading end of the recording material is detected by a top sensor 110, and the timing is matched. The recording material P fed at the predetermined timing is nipped and fed between the photosensitive drum 107 and the transfer roller 109 at a constant pressure. The recording material P having the toner image transferred thereonto is fed to the heat-fixing device 111 and is fixed into a permanent image there. Residual toner remaining on the photosensitive drum 107 without being transferred is removed from the surface of the photosensitive drum 107 by a cleaning device 112. Designated by 113 is a sheet discharge sensor provided in the heat-fixing device 111, and functions to detect sheet jamming between the top sensor 110 and the sheet discharge sensor 113

Figure 2:
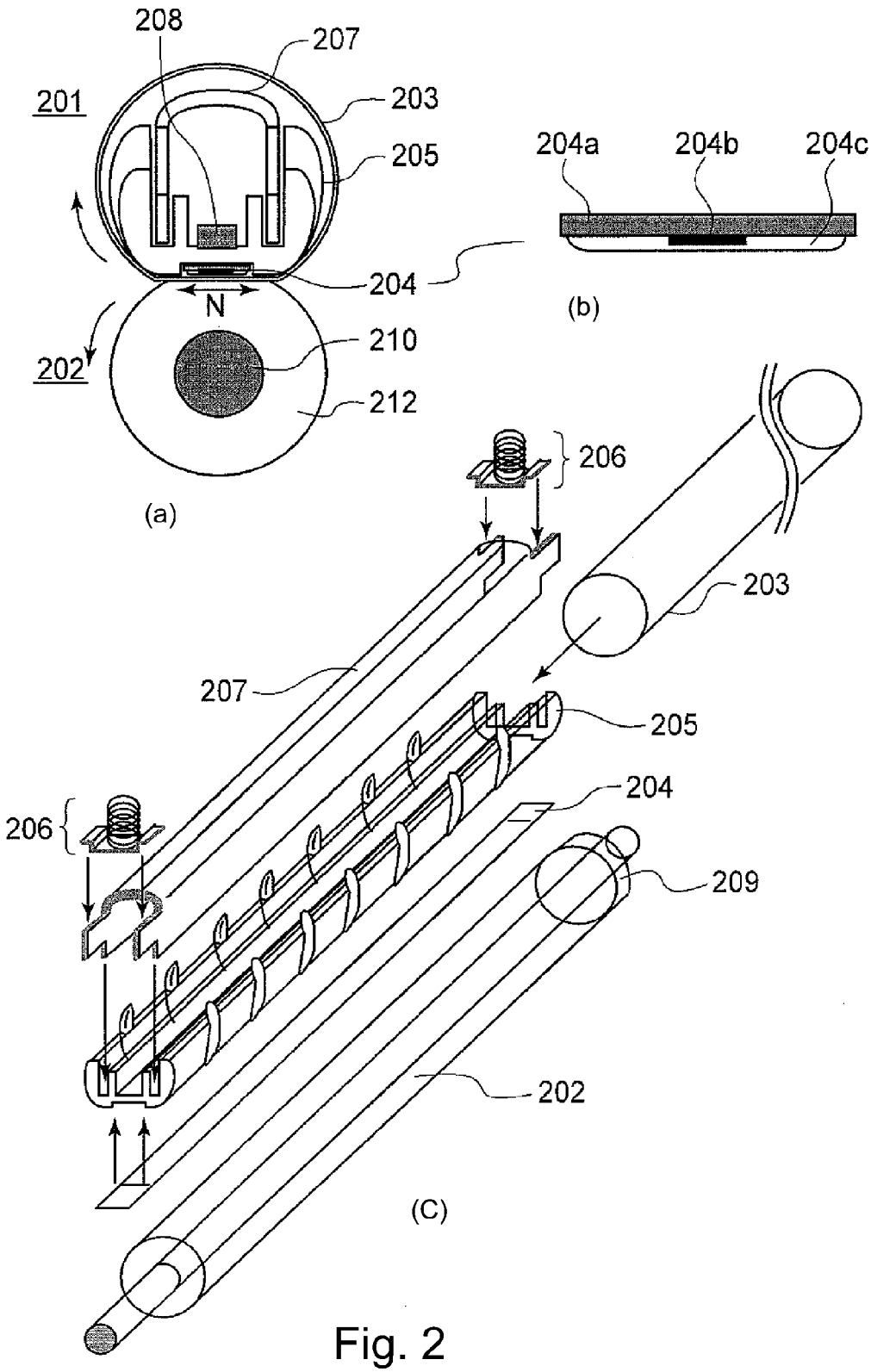
FIG. 2 illustrates a structure of a heat-fixing device.

FIG. 2 is a schematic illustration of the heat-fixing device (heating fixing portion) 111 provided in the image forming apparatus. The heat-fixing device 111 is a film heating type heat-fixing device fundamentally comprising a fixing assembly 201 and a pressing roller 202 which are press-contacted to each other to form a nip N.

As shown in sectional view (a) and perspective view (c) of FIG. 2, the fixing assembly 201 comprises mainly a fixing film 203, a heater 204, a heat-insulative holder 205 holding the heater 204, and a metal stay 207 for receiving the pressure from the urging spring 206 to urge the heat-insulative holder 205 against the pressing roller 202.

As shown in (b) of FIG. 2, the heater 204 as the heating member is contacted to the inner surface of the fixing film 203 to heat the nip N. The heater 204 is in the form of a plate and has a low thermal capacity, and comprises an insulative ceramic substrate 204*a* of alumina, aluminum nitride or the like, and an electric heat generating resistance layer 204*b* of Ag/Pd (silver-palladium), RuO2, Ta2 N or the like provided thereon by screen printing or the like. The surface of the heater 204 contacting the fixing film 203 is coated with a protection layer 204*c* for protecting the electric heat generating resistance layer which does not deteriorate the heat efficiency. The protection layer is preferably thin enough, and improves the surface property, and the material thereof is glass, fluorinated resin material or the like.

The heat-insulative holder 205 supporting the heater 204 is made of heat resistive resin material such as liquid crystal polymer, phenolic resin, PPS, PEEK or the like. The higher the thermal conductivity, the better the heat conduction to the pressing roller 202, and therefore, the resin material layer may contain glass balloon, silica balloon or another filler. The heat-insulative holder 205 functions also as a guide for rotation of the fixing film 203.

Designated by 207 is a metal stay and contacts the heat-insulative holder 205 to suppress the flexion and/or twisting of the entirety of the fixing assembly.

In a temperature control of the heater 204, in accordance with the signal from the temperature detecting element 208 such as a thermister provided on the rear surface of the ceramic substrate 204*a*, an unshown CPU determines a duty ratio, the number waves or the like of a voltage applied to the electric heat generating resistance layer to effect the proper control. By doing so, the temperature in the fixing nip is kept at a desired fixing set temperature.

Thus, a heat-fixing device shown in FIG. 2 comprising a heating element, a heat resistive film having one side slidingly contacting the heating element and the other side for contacting the recording material, a pressing member in the form of a roller for driving the heat resistive film and for urging the recording material toward the heating element through the heat resistive film. The heat resistive film and the recording material are nipped and fed together through the nip formed by the heating element and the pressing member, during which the recording material is heated.

Figure 3:
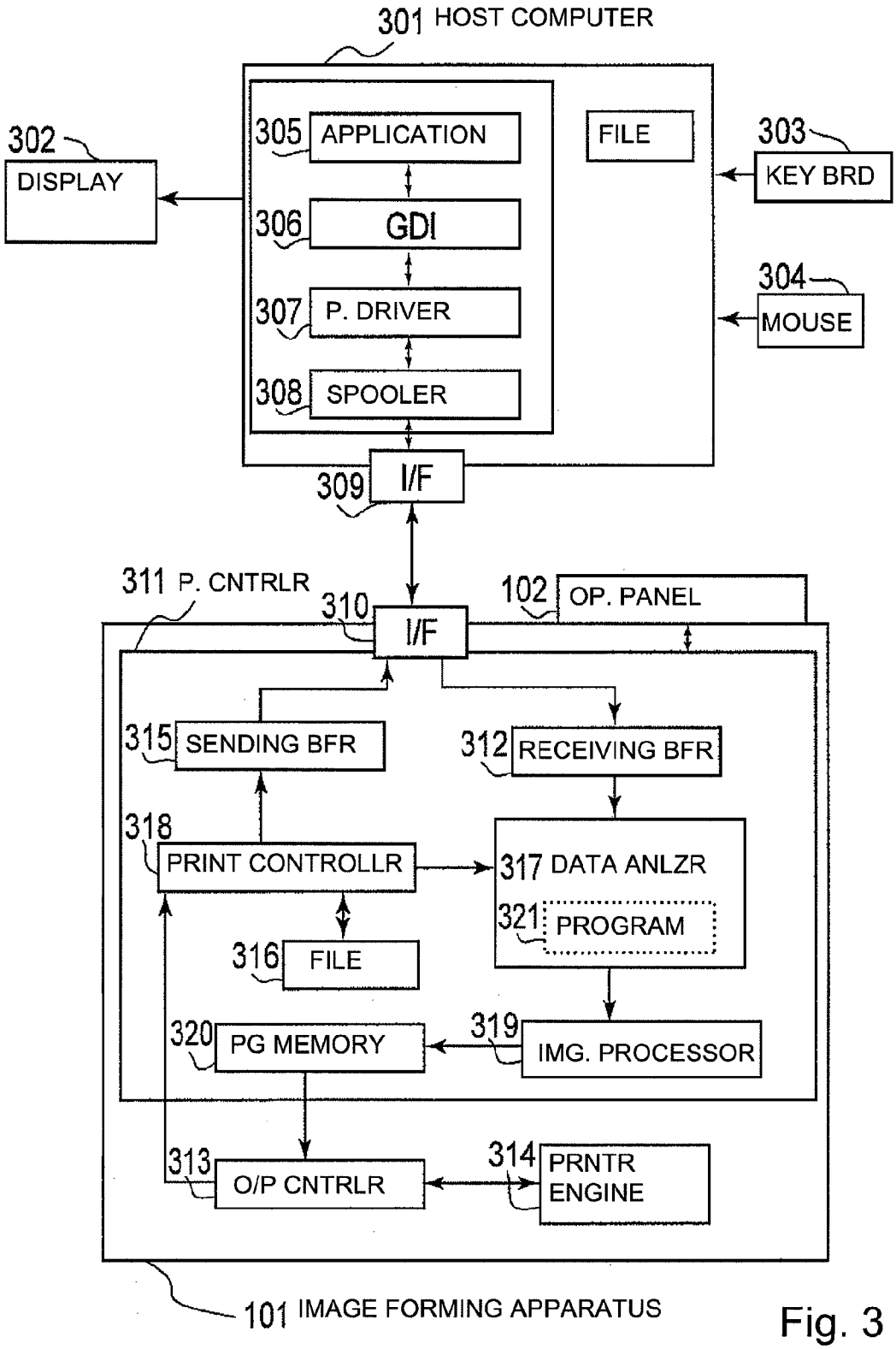
FIG. 3 is a block diagram schematically illustrating an image forming system in an Embodiment 1.

FIG. 3 is a block diagram showing a structure of the image forming system according to this embodiment, which comprises the host computer and the image forming apparatus (printing apparatus).

In FIG. 3, designated by 301 is a host computer and is effective to output the image data including print data or control code or the like to the image forming apparatus 101.

It may be of a single unit type of multiple unit type which may be connected wirelessly or non-wirelessly through a network such a LAN, as long as the function of the present invention is accomplished.

From the standpoint of functions, the image forming apparatus 101 generally comprises printing controller 311, an operation panel portion 102, an output controller 313 and a printer engine portion 314.

The printing controller 311 comprise an interface (I/F) portion 310 as a communicating portion with the host computer 301, a receive buffer 312 for temporarily holding managing the received data, a sending buffer 315 for holding temporarily and managing the sending data, a file system 316 which is a storing portion for storing various data, for execution of the printing control, a data analyzing portion 317 for controlling analysis of the print data, a printing control process executing portion 318, image processor 319, and a page memory 320 or the like.

The interface (I/F) portion 310 functions as a communicating portion for transaction of the print data with the host computer 301 and also as a state notifying portion for the state of the printer. The print data received through the interface (I/F) portion 310 and are stored in a 312 which is a storing portion for temporarily storing the data, and read out and processed by the data analyzing portion 317 when necessary. The data analyzing portion 317 comprises a control program 321 corresponding to each printing control command. The command analyzed by data analyzing portion 317 converts the result of the analysis of the print data relating to the imaging to universal intermediary codes which are easy to process by the image processor 319. The commands other than the imaging such as for sheet feed selection, form registration or the like are processed in the printing control process executing portion 318. In the image processor 319, each imaging command is executed by the middle code to load each object of the characters, the figures and the images into the page memory 320 when necessary.

Generally, the controller 311 is a computer system using a central processing unit (CPU), a read-only-memory (ROM), a random-access-memory (RAM) or the like. The processings of the each portion may be executed in time sharing under the control of a multi-task screen (real time, OS), or may be executed independently with preparation of an additional controller hardware. The operation panel portion 102 functions to set and display various states of the image forming apparatus. The output controller 313 converts the content of the page memory 320 to a video signal to feed the image to the printer engine portion 314. The printer engine portion 314 is an image forming device for forming a permanent visual image on the recording material on the basis of the received video signal, and has been in conjunction with FIG. 1.

The image forming apparatus 101 has been described, and the structure of the host computer 301 will be described, here.

The host computer 301 is a single computer system comprising keyboard 303 which is an input device, a mouse 304 which is a pointing device, a display screen 302 which is a display device. The host computer 301 is operated under the control of basic OS. Focusing the portion relating to the printing alone, the function in the basic OS is divided into a graphic device interface (GDI) 306 which is a part of the functions of application software 305 and the basic OS, and a printer spooler 308 for temporarily storing the data generated by the printer driver 307 and the printer driver.

Generally, in the host computer 301, the hardware such as the central processing unit (CPU), the read-only-memory (ROM), the random-access-memory (RAM) and the like is controlled by basic software to operate application software which is under the control of the basic software. The printer driver 307, the printer spooler 308 or the like is one of the application software. By the application software 305, various data editing operations for the texts, the figures and the images can be executed, and when the data are to be printed, an unshown print instructing portion is selected by the mouse 304 or the like to execute the printing.

Then, the application software 305 calls GDI 306 which is a function of a part of the basic OS. The GDI 306 is a group of basic functions for controlling the display device such as the screen display on the display screen 302, the print output or the like, and the printing device. Various application software use the basic functions to execute the operations irrespective of difference of the equipment (hardware).

In the GDI306, the information on the imaging performance or print resolution or the like of the printing device is fetched from the printer driver 307 which controls the information depending on the actual equipment of the image forming apparatus, and the GDI function called from application software 305 is analyzed, and The information is supplied to the printer driver 307 currently selected The printer driver 307 generates the print data adapted to the functions of the used printing apparatus on the basis of information received from the GDI306, and the printing ambient condition setting set by the graphical user interface (GUI) possessed by itself or set by the character user interface (CUI).

The generated print data may be a group of commands when the image forming apparatus is capable of understanding the printer language (PDL), the image data when the image forming apparatus side effects only the image process, or all the data corresponding to the functions and power of the image forming apparatus.

The print data thus generated are stored temporarily by the data storing portion called printer spooler 308. The printer spooler 308 is effective to release the application software from the printing process quickly.

That is, if the print data is sent directly to the image forming apparatus, the reaching to the capacity of the receiving buffer 312 of the image forming apparatus or the occurrence of off-line state of the communicating portion for one reason or another (sheet jamming, for example) prevents the host computer 301 from sending the print data, with the result of interruption of the printing process of the application software.

By the provision of the means for temporarily storing the data, upon sending all of the print data into the storing portion, the application software is released from the required printing process operation.

The print data thus generated is temporarily accumulated by the data storing portion, that is, the printer spooler 308, and thereafter, is delivered to the image forming apparatus 101 through the I/F portion 309 which is the communicating portion of the host computer 301. The I/F portion 309 functions also to receive the printing information from the image forming apparatus 101.

The description has been made as to various elements relating to this embodiment, and then the overall operations will be described.

With respect to this embodiment, a basic example of an execution of a printing mode execution for a small size sheet using the host computer 301 will be described. For the document edited and made by the user on the application software (application) 305, the user effects the printing instructions, and then the application software 305 calls the GDI 306 which is a part of the functions of the basic OS. The GDI 306, fetches the information of the imaging performance of the image forming apparatus, the print resolution and the like from the printer driver 307 managing the information dependent on the current equipment of the image forming apparatus, and analyzes the GDI function called from application software 305, and expands the document data (information) into bit map data, and sends the data to the currently selected printer driver 307 as image data.

The printer driver 307 receives the document data received from the GDI306 and the printing setting information set by the graphical user interface (GUI) of the printer driver 307.

Figure 4:
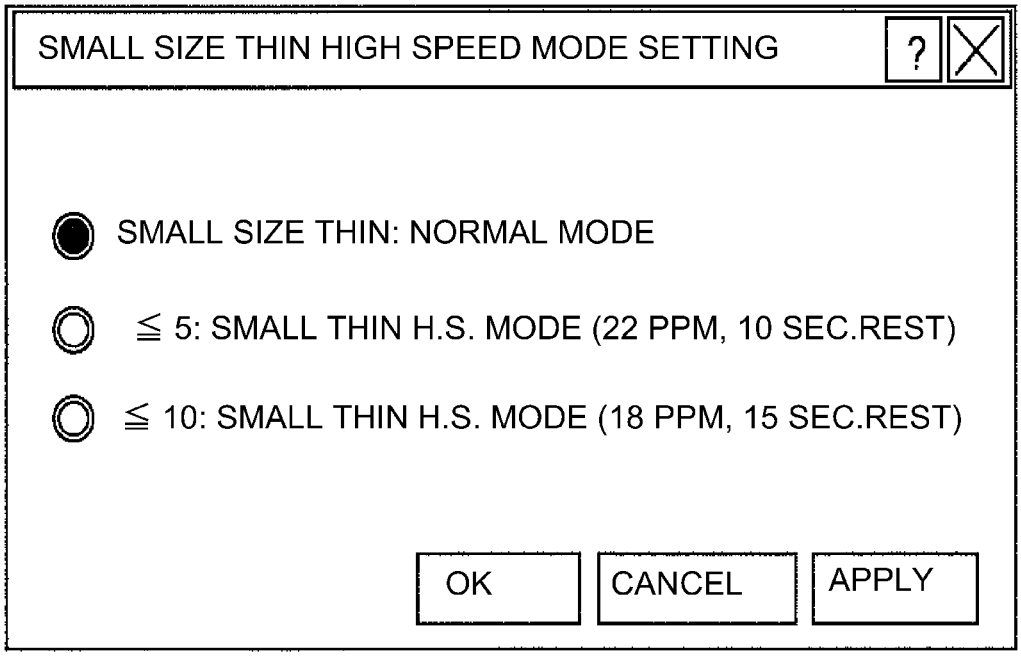
FIG. 4 shows an example of a setting screen for a small size paper printing.

FIG. 4 illustrates an example of a print setting screen displayed on the display screen 302, that is, the GUI screen of the printer driver 307 in this embodiment. The user selects the mode on the screen.

The image forming apparatus of this embodiment is operable for printing of a small size sheet having a width smaller than a maximum operable width of the image forming apparatus, in a normal mode (first small size paper printing mode) and in a high speed output mode (second small size paper printing mode). Upon printing for a small size sheet, the normal mode and the high speed output mode are selectable by the GUI of the printer driver 307. When the high speed output mode is selected, the throughput is higher than in the normal mode, and after the end of the printing, a rest period for a predetermined length is executed, as a feature of this embodiment. The image forming apparatus is operable, for printing on the recording material having a small size which is narrower the maximum operable width of the image forming apparatus, the first small size paper printing mode and a second small size paper printing mode in which the output number per unit time is larger than in the first small size paper printing mode with limited continuously outputtable number.

Figure 5:
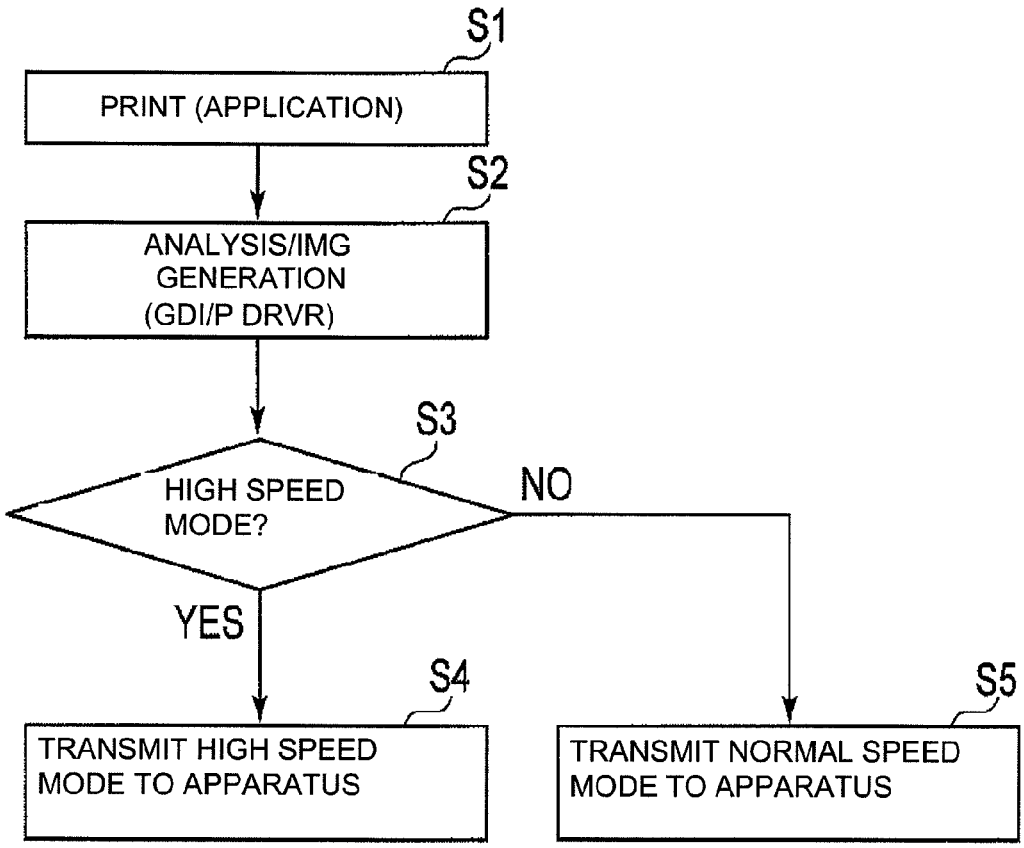
FIG. 5 is a flow chart showing processing in Embodiment 1.
Figure 6:
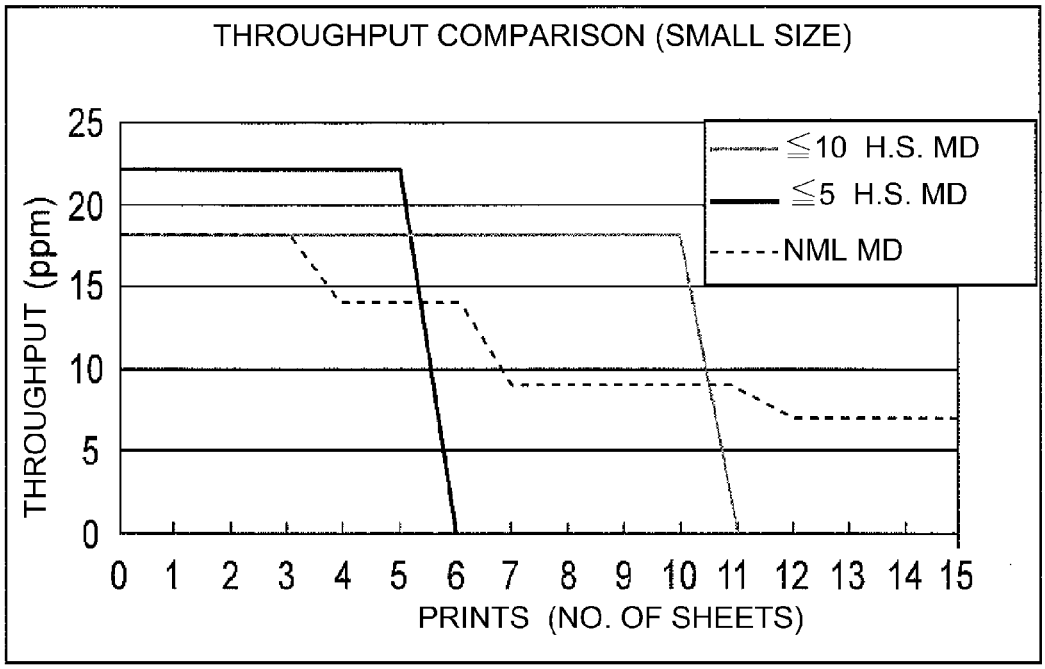
FIG. 6 shows throughput comparison in Embodiment 1.

FIG. 5 is a flow chart of data processing. Table 1 shows an example of setting of the high speed output mode in this embodiment, and FIG. 6 shows each throughput.

TABLE 1

Example of high speed output mode setting

| | Throughputs | Rest period after printing |
|---|---|---|
| Normal small size sheet mode | 18 ppm-14 ppm-9 ppm | No |

TABLE 1-continued

Example of high speed output mode setting

| | Throughputs | Rest period after printing |
|---|---|---|
| High speed output mode for 5 or less sheets | 22 ppm(constant at full speed) | 10 sec |
| High speed output mode for 10 or less than 10 sheets | 18 ppm (constant) | 15 sec |

A plurality of such user output modes are provided, and the user can select one of them in consideration of the printing number and the rest period. As shown in Table 1, in the high speed output mode (second small size paper printing mode), the output number per unit time is larger than in the normal mode, but the continuously outputtable number is limited. Therefore, when the required print number is small, (not more than 5 or 10 in this embodiment), the selection of the high speed output mode is advantageous in that the time required for finishing all the prints is relatively shorter. However, in the high speed output mode, the rest of printing time is required after a predetermined number of prints are continuously outputted, and therefore, when the required print number is large, the selection of the normal mode results in the shorter time until the required number of prints are finished. In this embodiment, two high speed output modes are prepared in addition to the normal mode, but the number of the high speed modes may be n ($n \geqq 1$) for which the description of this embodiment similarly applies. In the high speed output modes, the throughputs may be the same, or may be different, that is, throughput down is used. In the high speed output mode of 22 ppm, when the small size sheets are continuously outputted, the continuously outputtable number is limited to 5 sheets so that the non-sheet-passage-part of the fixing portion does not exceed the durable temperature of the fixing portion. In the high speed output mode of 18 ppm, when the small size sheets are continuously outputted, the continuously outputtable number is limited to 10 sheets so that the non-sheet-passage-part of the fixing portion does not exceed the durable temperature of the fixing portion.

Referring to FIG. 5, the operation of the apparatus of this embodiment will be described. The processing operation in accordance with the flow chart is carried out by an unshown CPU in the host computer. Here, the small size sheet high speed output mode I is the high speed output mode not more than 10 sheet, and the small size sheet high speed output mode II is the high speed output mode not more than 5 sheets.

When the printing instructions for the small size sheets is produced in the application (step 1 (S1)), the image data is analyzed in step 2, and the image is generated, and the printing number is calculated. In step 3, the discrimination is made as to whether or not small size sheet high speed output mode I or II is selected by the user, and if so, the operation goes to step 4, and the selected high speed output mode I or II is transmitted to the image forming apparatus.

If the high speed small size sheet output mode is not selected by the user, the operation goes to step 5, where the normal small size sheet mode is transmitted to the image forming apparatus.

In this embodiment, it is supposed that the user selects the high speed small size sheet output mode for each printing job, but this embodiment is not limited to such an example, and the selection of the high speed small size sheet output mode can be registered.

Figure 7:
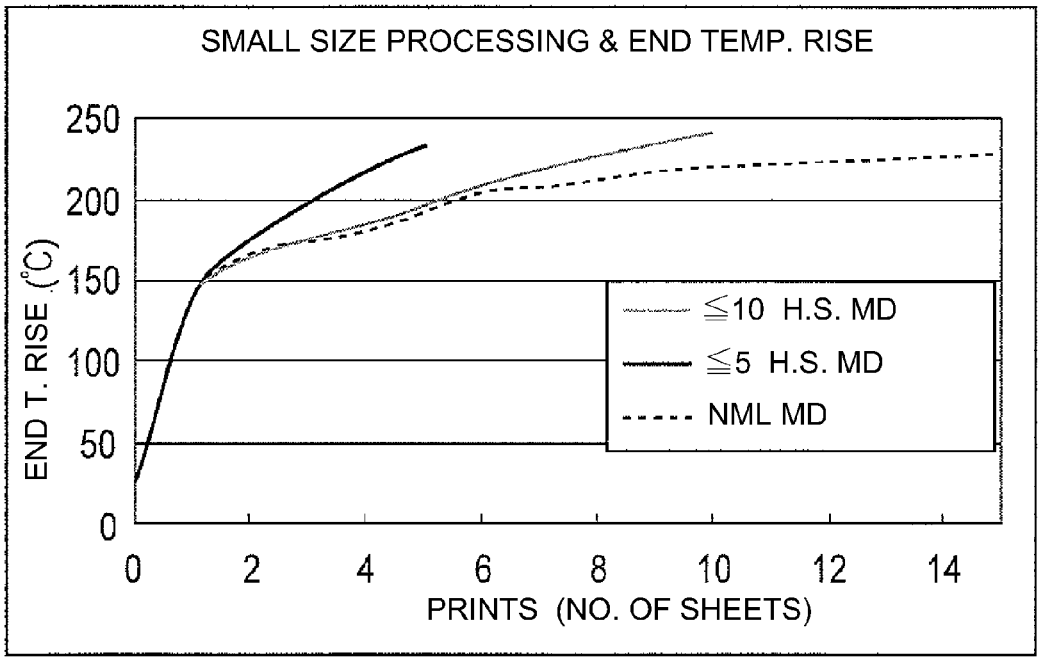
FIG. 7 shows results of end temperature raising experiments in Embodiment 2.

FIG. 7 shows results of measurement and comparison of the temperature rise of the end portion of the ceramic heater with the settings of this embodiment. The permissible temperature for the temperature rise of the end of the ceramic heater is 260° C., and the temperature rises in any case are within the limit.

It has been confirmed empirically that according to this embodiment, 27% speed-up for the case of 5 or less small size sheet outputs and 33% speed-up for 10 or less small size sheet outputs are accomplished.

As described in the foregoing, according to this embodiment, the throughput of small size sheet printing is improved, when a limited number of small size sheets are randomly outputted. This improves the practical operability. According to this embodiment, it is unnecessary to change the hardware structure, but modifications in the information processing are required, and therefore the cost for the change is low.

Embodiment 2

The image forming system according to Embodiment 2 will be described. In this embodiment, when the user selects a high speed small size sheet output mode but there is another mode with which the output speed is higher as a result of calculation, the mode is automatically switched to the highest speed output setting. The general structure of this embodiment is similar to that of Embodiment 1, and therefore, the detailed description thereof is omitted.

The description will be made as to the case of the high speed output modes shown in Table 1.

When the user selects the high speed output mode I for not more than 10, but the actual printing number is not more than 5 as a result of the calculation in the printer driver, the output mode is automatically switched to the high speed output mode II with which the output speed is higher.

Figure 8:
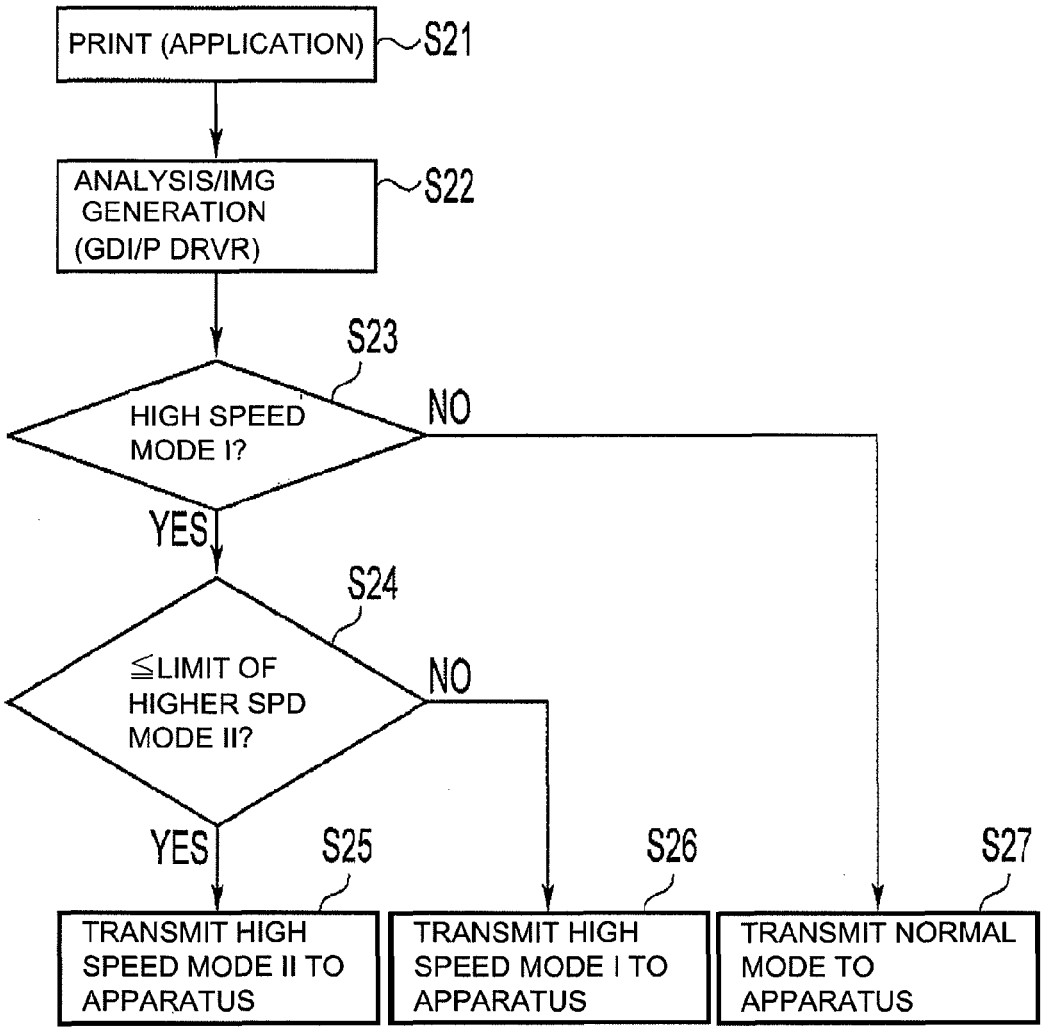
FIG. 8 is a flow chart showing processing in Embodiment 2.

Referring to the flow chart of FIG. 8, a processing in this embodiment will be described.

Here, the small size sheet high speed output mode I is the high speed output mode for not more than 10 sheets, and the small size sheet high speed output mode II is the higher high speed output mode for not more than 5 sheets.

When the printing instructions for small size sheets are produced by the application software (step 21), the image data are analyzed to generate images, and the printing number is calculated in step 22. In step 23, the discrimination is made as to whether or not the high speed small size sheet output mode I is selected by the user, and if so, the operation goes to step 24. If not, the operation goes to step 27 where the normal small size sheet mode is transmitted to the image forming apparatus.

The discrimination is made as to whether or not the printing number calculated in the step 24 is not more than 5 which is the upper limit number in the high speed small size sheet output mode II, and if it is not more than 5, the operation goes to step 25, and the high speed small size sheet output mode II is transmitted to the image forming apparatus as the output mode to be executed. If it exceeds 5, the operation goes to step 26, and the high speed output mode I is transmitted to the image forming apparatus.

As described in the foregoing, according to this embodiment, when a high speed output mode, which is higher than the high speed small size sheet output mode selected by the user, is applicable, the higher speed mode is automatically applied, and therefore, the operability is improved.

Embodiment 3

The image forming system according to Embodiment 3 will be described. In this embodiment, when the calculated printing number is larger than the upper limit number in the high speed small size sheet output mode selected by the user, and there is a high speed small size sheet output mode applicable to the number, the output mode is automatically switched to the applicable small size sheet high speed output mode The general structure of this embodiment is similar to that of Embodiment 1, and therefore, the detailed description thereof is omitted.

The description will be made as to the case of the high speed output modes shown in Table 1. When the user selects the high speed small size sheet output mode II for not more than 5 sheets, and the actual printing number outputted from the printer driver is more than 5, the mode is automatically switched to the small size sheet high speed output mode I for not more than 10, in this example.

Figure 9:
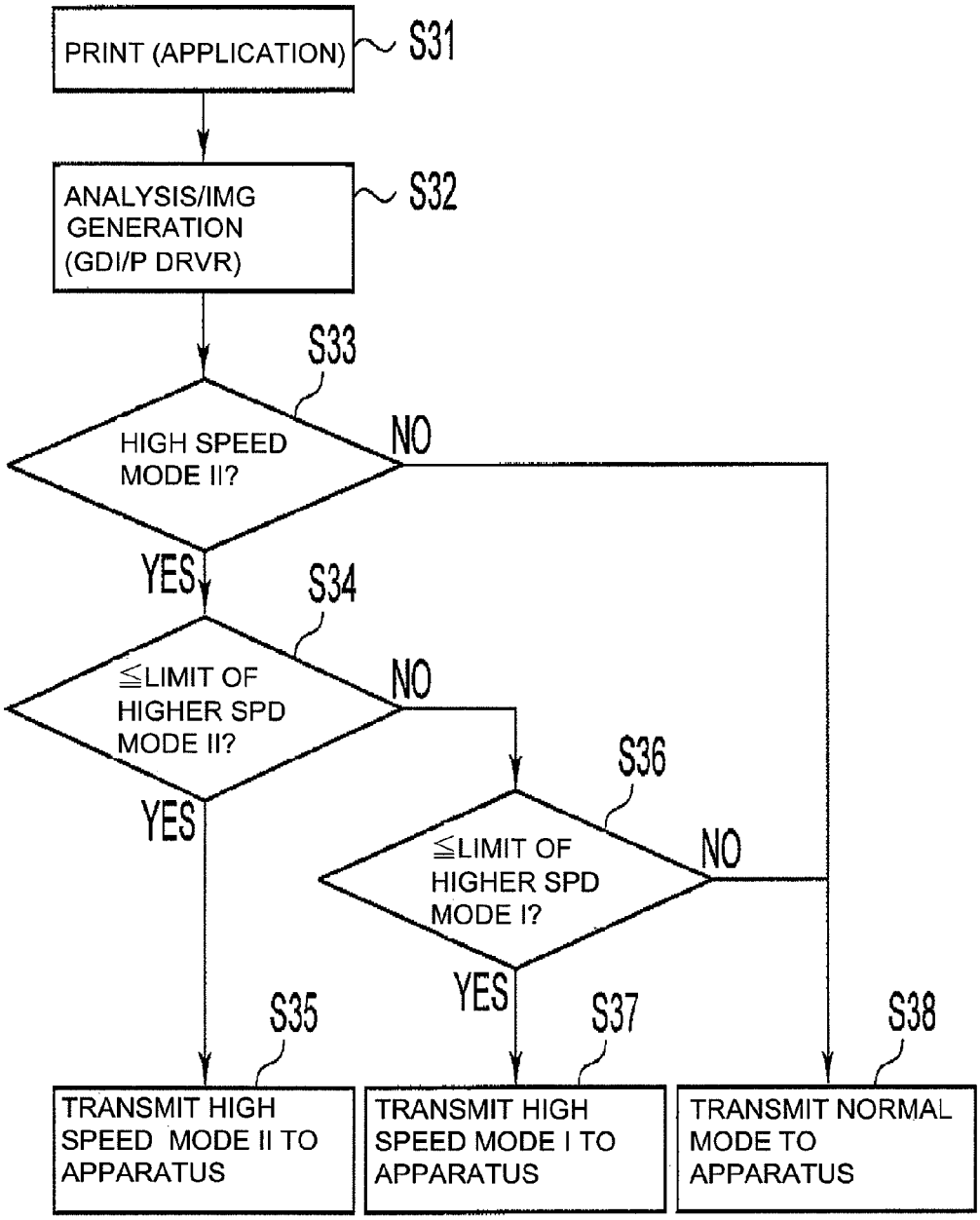
FIG. 9 is a flow chart showing processing in Embodiment 3.

Referring to a flow chart of FIG. 9, the processing in this embodiment will be described. Here, the small size sheet high speed output mode I is the high speed output mode for not more than 10 sheets, and the small size sheet high speed output mode II is the higher high speed output mode for not more than 5 sheets.

When the printing instructions for small size sheets are produced by the application software (step 31), the image data are analyzed to generate images, and the printing number is calculated in step 31. In step 33, the discrimination is made as to whether or not the user selects the high speed small size sheet output mode II, and if so, the operation goes to step 34, and if not, the operation goes to step 38 where the normal small size sheet mode is transmitted to the image forming apparatus.

In step 34, the discrimination is made as to whether or not the calculated printing number is not more than 5 which is the upper limit number in the high speed small size sheet output mode II, and if so, the operation goes to step 35, and the high speed small size sheet output mode II is transmitted to the image forming apparatus. If it exceeds 5, the operation goes to step 36, and the discrimination is made as to whether or not the calculated printing number is not more than 10 which is the upper limit number of the high speed output mode I, and if it is not more than 10, the operation goes to step 37, where the high speed small size sheet output mode I is transmitted to the image forming apparatus. If it exceeds 10, the operation goes to step 38, the normal small size sheet mode is transmitted to the image forming apparatus.

As described in the foregoing, according to this embodiment, even if the small size sheet high speed output mode required by the user is improper for the printing number, if a lower speed small size sheet high speed output mode is applicable, the applicable small size sheet high speed output mode is automatically applied, and therefore, the operability is improved.

Embodiment 4

The image forming system according to Embodiment 4 will be described. In this embodiment, when the calculated printing number is larger than the limit number of the small size sheet high speed output mode selected by the user, the output mode is automatically switched to the normal small size sheet mode printing The general structure of this embodiment is similar to that of Embodiment 1, and therefore, the detailed description thereof is omitted. The description will be made as to the case of the high speed output modes shown in Table 1. When the user selects the high speed output mode for not more than 5, and the actual printing number outputted from the printer driver is larger than 6, the operation automatically goes out of the high speed output mode to the normal small size sheet mode printing.

Figure 10:
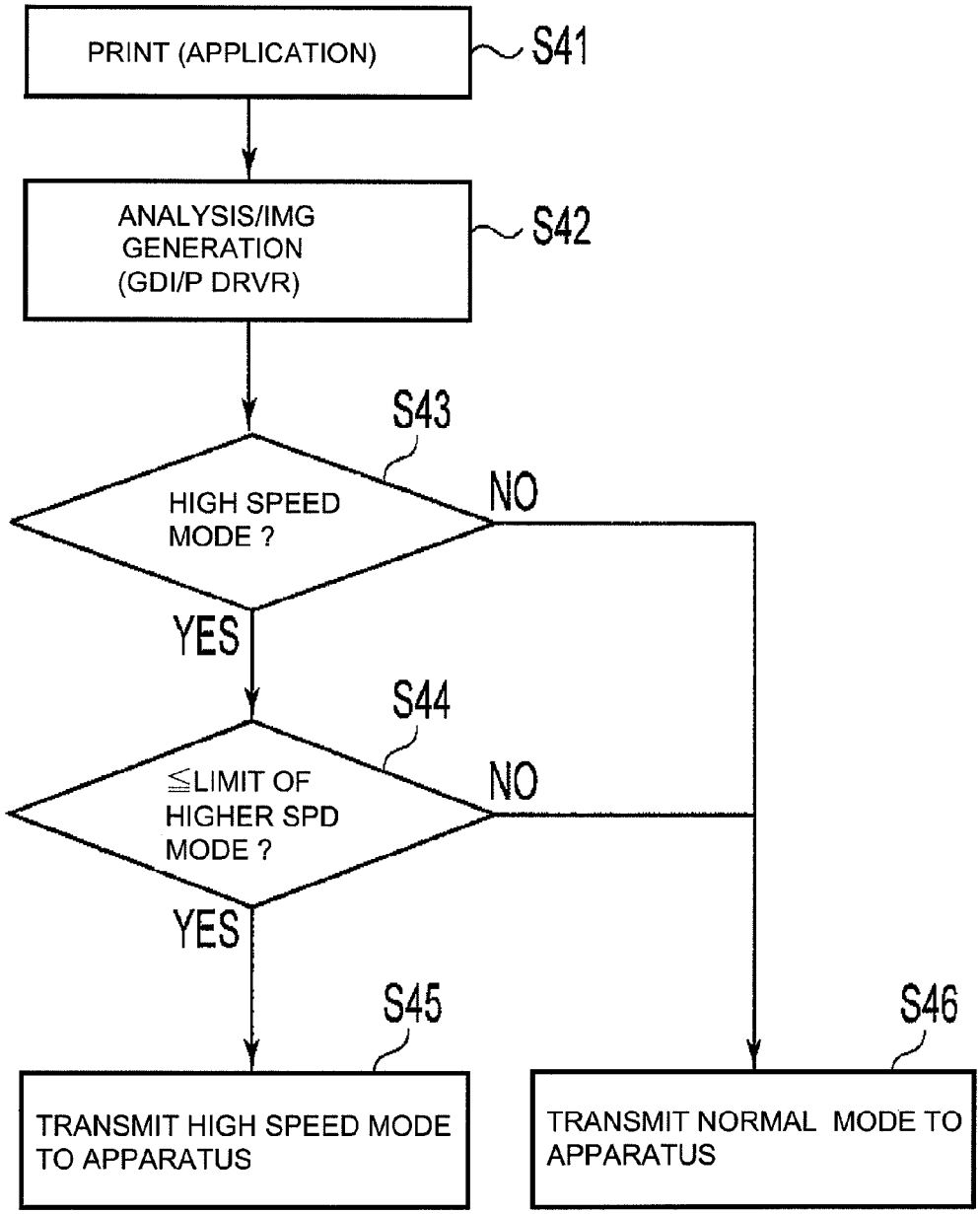
FIG. 10 is a flow chart showing processing in Embodiment 4.

FIG. 10 shows a flow chart of the data processing. When the printing instructions for small size sheets are produced by the application software (step 41), the image data are analyzed to generate images, and the printing number is calculated in step 42. In step 43, the discrimination is made as to whether or not small size sheet high speed output mode I or II is selected by the user, and if so, the operation goes to step 44, and if not, it goes to step 46, where the normal small size sheet mode is transmitted to the image forming apparatus In step 44, the discrimination is made as to whether or not the calculated printing number is not more than the upper limit number of the selected small size sheet high speed output mode. If it is not more than the upper limit number, the operation goes to step 45, where the high speed small size sheet output mode is transmitted to the image forming apparatus If it exceeds the upper limit number, the operation goes to step 46, and the normal small size sheet mode is transmitted to the image forming apparatus irrespective of selection of the small size sheet high speed output mode.

As described in the foregoing, according to this embodiment, the mode is determined taking into account the calculated printing number, and therefore, the operation more assured than in Embodiment 1.

Embodiment 5

The image forming system according to Embodiment 5 will be described. In this embodiment, when the small size sheet high speed output mode is selected, the availability of the high speed small size sheet output mode is determined on the basis of an initial detected temperature of the temperature detecting element of the heat-fixing device, in this example. The general structure of this embodiment is similar to that of Embodiment 1, and therefore, the detailed description thereof is omitted.

In this embodiment, when the initial detected temperature of the temperature detecting element disposed on a back side of the heater substrate of the heating fixing device is not more than 100° C., the execution of the small size sheet high speed output mode printing is permitted When it is higher than 100° C., the mode is automatically switched to the normal mode printing even if the small size sheet high speed output mode printing is selected.

Figure 11:
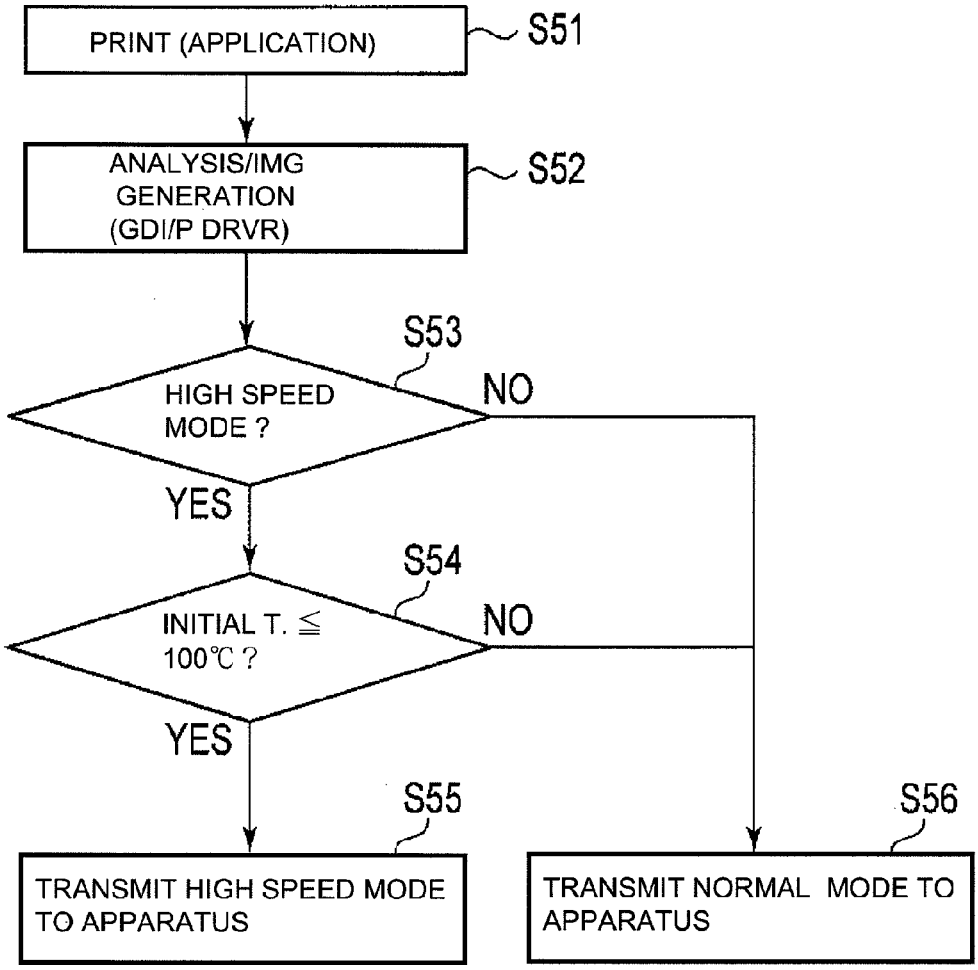
FIG. 11 is a flow chart showing processing in Embodiment 5.

FIG. 11 shows a flow chart of the data processing. When the printing instructions for small size sheets are produced by the application software (step 51), the image data are analyzed to generate images, and the printing number is calculated in step 52. In step 53, the discrimination is made as to whether or not the small size sheet high speed output mode I or II is selected by the user, and if so, the operation goes to step 54 If not, the operation goes to step 56, the normal small size sheet mode is transmitted to the image forming apparatus. In step 54, the discrimination is made as to whether or not the initial detected temperature of the temperature detecting element is not more than 100° C., and if it is not more than that, the selected small size sheet high speed output mode is transmitted to the image forming apparatus, when the temperature exceeds 100° C., the operation goes to step 56, and the normal small size sheet mode is transmitted to the image forming apparatus. By doing so, the damage of the fixing device attributable to the over-heating can be prevented

Embodiment 6

Figure 12:
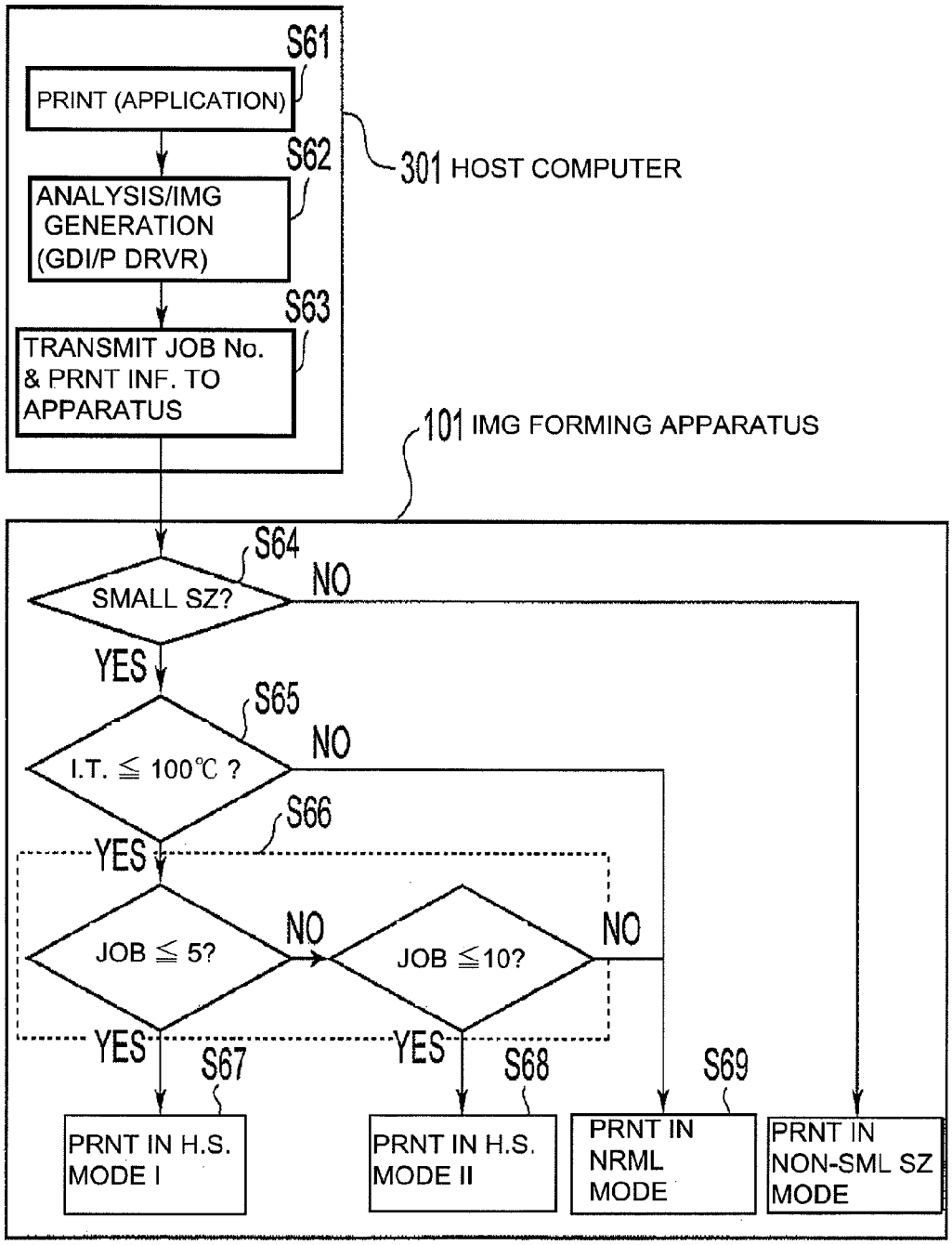
FIG. 12 is a flow chart showing processing in Embodiment 6.

The image forming system according to Embodiment 6 will be described. In Embodiments 2-5, selection of the printing mode is carries out in the host computer, but in this embodiment, the selection of the printing mode is carries out in the image forming apparatus upon the small size paper printing Operates are similar to those of Embodiments 1-6, but the setting which is considered as being optimum as the printing performance for the small size sheet is built in beforehand, by which the user is not required to carry out an additional setting on the host computer 301, thus facilitating the operation. FIG. 12 is a flow chart the data processing in this embodiment In this embodiment, when the host computer produces the printing instructions for the small size sheet (step 61), the print data are analyzed, and the image formation and determining of the printing number are carried out (step 62), and thereafter the printing information is sent to the image forming apparatus (step 63). The image forming apparatus discriminates on the basis of the received information whether or not the print is on a small size sheet, and if it is on the small size sheet, it is checked whether or not the initial temperature of the temperature detecting element provided on the back side of the heater substrate of the heating fixing device is not more than the threshold (100° C., here), to discriminate whether or not the small size sheet high speed output mode is applicable (step 65) When the small size sheet high speed output mode is applicable, and the number of the printing job is not more than 5 as a result of referring to the print job number (step 66), the small size sheet high speed output mode I is used (step 67). In the small size sheet high speed output mode I, the prints are outputted at the full speed 22 ppm, and thereafter, 10 sec rest time is executed. If the number in the printing job is not less than 6 and not more than 10, the small size sheet high speed output mode II is applied (step 68) In the small size sheet high speed output mode I, the prints are outputted at the full speed 18 ppm, and thereafter, 15 sec rest time is executed. If the number in the printing job is not less than 11, the normal small size sheet mode is used in which the throughput speed is stepwisely decreased in accordance with the printing number (step 69). In this embodiment, the speed is 18 ppm up to 3 sheets, 14 ppm up to 6 sheets, 9 ppm up to 11 sheets, and 7 ppm up to 21 sheets, and 6 ppm for 22 and more sheets.

The settings are determined in consideration of the frequency of the continuous printing numbers of small size sheet, the frequency of the intervals of the generations of the printing job, and the sensory convenience. The embodiment shows only an example, and the applicability temperature threshold setting, the printing number of the small size sheet, the throughput, and the rest time are not limited to the foregoing examples.

Embodiment 7

Embodiment 7 of the present invention will be described. This embodiment is different from Embodiments 1-6 in that the recording material feeding speed in the second small size paper printing mode (high speed small size sheet output mode) is higher than the first small size paper printing mode (small size sheet normal output mode). The target temperature (fixing temperature) during the fixing process of the fixing portion in the first small size paper printing mode is set to be lower than the target temperature (fixing temperature) during the fixing process of the fixing portion in the second small size paper printing mode.

[Image Forming Apparatus]

Figure 13:
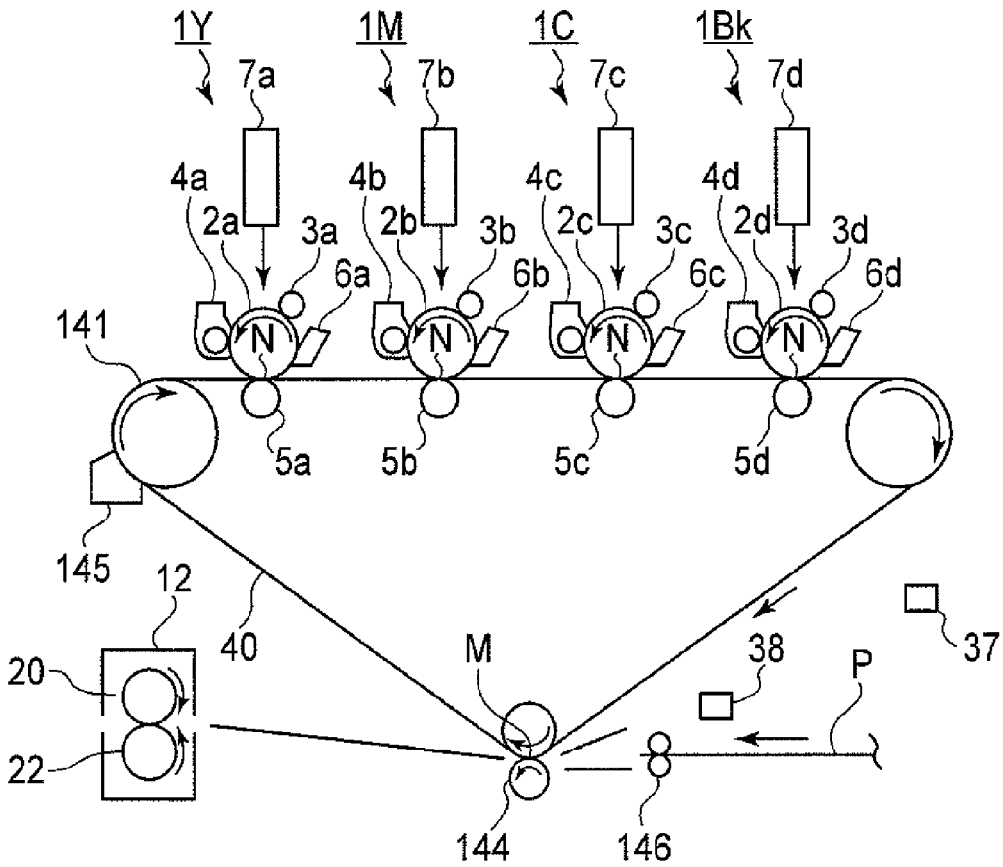
FIG. 13 is a schematic sectional view of a color image forming apparatus and a fixing device.
Figure 13:
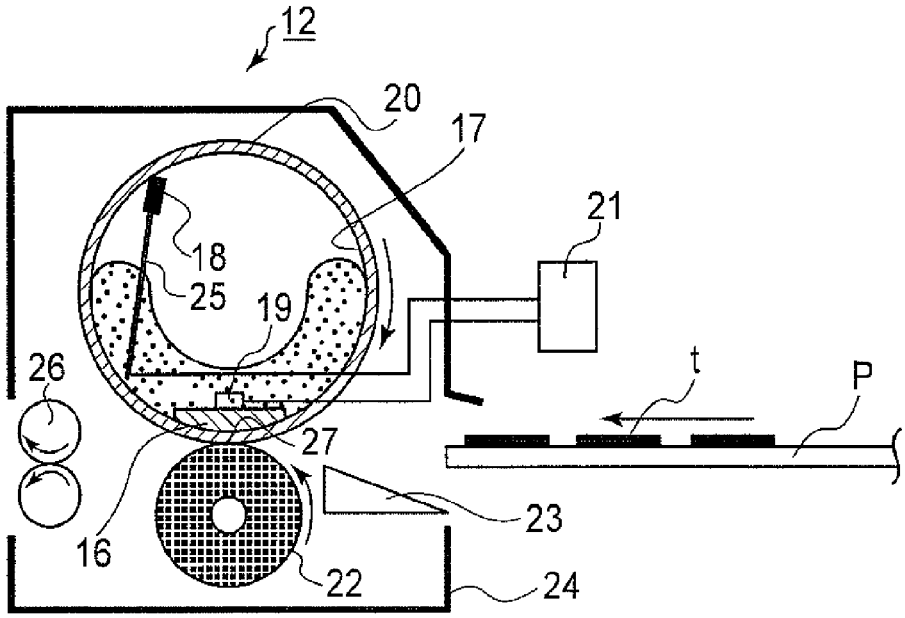

Part (a) of the FIG. 13 is a schematic illustration of a color image forming apparatus according to Embodiment 7, wherein the image forming apparatus of the this embodiment is a tandem type full color printer using an electrophotographic system, in which recording materials up to A3 size can be processed. The image forming apparatus comprises four image forming station (image forming units), namely, image forming stations 1Y, 1M, 1C, 1Bk for forming yellow (Y), magenta (M), cyan (C) and black (Bk) images, respectively, and they are arranged in one line at constant intervals In the Figure, a, b, c and d correspond to Y, M, C and Bk, respectively, and are omitted unless they are necessary.

When the start signal for the image forming operation is produced, the photosensitive drum 2 of the image forming station 1 is rotated in a direction indicated by the arrow at a predetermined process speed (peripheral speed), and is charged uniformly to a negative polarity, for example. An exposure device 7 converts the image signal inputted and color-separated to a light signal by a laser output portion (unshown), and the laser beam as the light signal scans the charged photosensitive drum 2 to form an electrostatic latent image. The developing device 4*a* is supplied with a developing bias voltage having the same polarity as the charge polarity (negative) to electrostatically deposit yellow toner onto the electrostatic latent image formed on the photosensitive drum 2*a* in accordance with the charged potential, thus visualizing the electrostatic latent image into a developed image. The transfer roller 5*a* is supplied with a primary transfer bias having a polarity opposite that of the toner (positive) to transfer (primary transfer) the yellow toner image onto an intermediary transfer belt 40 rotated in the direction indicated by the arrow by a driving roller 141 in a primary transfer nip N, and the intermediary transfer belt 40 advances toward the image forming station 1M. In the same manner, on the yellow toner image on the intermediary transfer belt 40, magenta, cyan and black toner images formed on the photosensitive drums 2*b*, 2*c*, 2*d* are sequentially overlaid in the primary transfer portions N, thus forming a full-color toner image.

A registration roller 146 feeds the recording material P to a secondary transfer nip M in timed relation with movement of the leading end of the full-color toner image on the intermediary transfer belt 40 to the secondary transfer nip M. The secondary transfer roller 144 is supplied with a secondary transfer bias voltage having a polarity opposite that of the toner (positive) to transfer the full-color toner image all together onto the recording material (secondary transfer). a fixing device 12 heats and presses the fed recording material P by the fixing nip between the fixing sleeve 20 and the pressing roller (pressing member) to fuse and fix the toner image on the recording material P Thereafter, the recording material P is discharged to the outside, by which the series of image forming operations is completed. The untransferred toner remaining on the photosensitive drum 2 during the primary transfer is removed and collected by a drum cleaning device 6, and the after-secondary-transfer residual toner remaining on the intermediary transfer belt 40 after the secondary transfer is removed and collected by a belt cleaning device 145.

The image forming apparatus includes a ambient condition sensor 37 to be used for adjustment of the density of the toner image formed on the recording material P and for accomplishing optimum transfer and fixing conditions the conditions of the bias voltages of the charging, the development, the primary transfer and the secondary transfer can be changed in accordance with the ambient condition (temperature and humidity) in the image forming apparatus In order to accomplish the optimum transfer and fixing conditions for the recording material P, a media sensor 38 is provided, and the kind of the recording material P is discriminated to change the transfer bias and the fixing condition

[Fixing Device 12]

Part (b) of the FIG. 13 is a schematic illustration of the fixing device 12 of the this embodiment, and the fixing device 12 is a heating apparatus of fixing sleeve heating type and pressing rotating member drive type (tensionless type) The fixing sleeve 20 is a cylindrical (endless belt) member comprising a belt and a elastic layer thereon, and the pressing roller 22 is a back-up member, and a heater holder 17 is a heat resistive rigid member having a substantially arcuate cross-section (trough like). The fixing heater 16 is a heating element (heat source) and is a ceramic heater, for example, and is extended along the longitudinal direction (perpendicular in the feeding direction of the recording material) of the heater holder 17 on the lower surface of the heater holder 17. The fixing sleeve 20 is loosely telescoped around the heater holder 17. The heater holder 17 is made of liquid crystal polymer resin material having a high heat resistive and supports the fixing heater 16 and guides the fixing sleeve 20 In this embodiment, it is liquid crystal polymer (Sumicus Super LCP, E4205L (tradename the available from Sumitomo Kagaku Kabushiki Kaisha, Japan). The maximum usable temperature of E4205L (limit temperature due to flexure by the load) is approx. 305° C.

The pressing roller 22 comprises a hollow core metal of aluminum, steel (STKM, carbon steel tube for machine structure JIS G 3445) or the like, a silicone rubber layer having a thickness of approx. 3 mm thereon, and a PFA resin material tube having a thickness of approx. 50 μm thereon. The opposite end portions of the pressing roller 22 are rotatably supported by bearings provided at the rear side and the front side of the device frame 24 Above the pressing roller 22, a fixing sleeve unit including the fixing heater 16, the heater holder 17, the fixing sleeve 20 and so on is provided in parallel with the pressing roller 22, with the fixing heater 16 facing down. The opposite end portions of the heater holder 17 are urged toward the axis of the pressing roller 22 by an unshown pressing mechanism by a force of 147 N (15 kgf) at each end, and total pressure of 294 N (30 kgf). By doing so, the downward surface of the fixing heater 16 is urged toward the elastic layer of the pressing roller 22 through the fixing sleeve 20 against the elasticity of the elastic layer at a predetermined urging force to form a fixing nip 27 having a predetermined width enough for the heating and fixing. The pressing mechanism is provided with an automatic pressure varying mechanism to change the pressure in accordance with the kind of the recording material P.

Designated by 23 and 26 are an entrance guide and a fixing and sheet discharging roller, and the entrance guide 23 guides the recording material P such that the recording material P fed from the secondary transfer nip M is correctly guided to the fixing nip 27. In this embodiment, the entrance guide 23 is made of Hyperlite (tradename) which is a reformulated PET (polyethylene terephthalate) resin material available from Kabushiki Kaisha Kaneka, Japan.

The pressing roller 22 is rotated at a predetermined peripheral speed in the counterclockwise direction indicated by arrow by unshown driving means, and the rotational force is applied to the fixing sleeve 20 by the press-contact frictional force in the fixing nip 27. The fixing sleeve 20 is rotated in the clockwise direction indicated by the arrow outside the heater holder 17, while the inner surface of the fixing sleeve 20 is in sliding close-contacted with the downward surface of the fixing heater 16. Grease is applied to the inner surface of the fixing sleeve 20 to assure the slidability between the heater holder 17 and the inner surface of the fixing sleeve 20. The pressing roller 22 is rotated, and the fixing sleeve 20 is rotated thereby, and the fixing heater 16 is supplied with the electric power to heat it to a predetermined temperature, and is controlled in the temperature by the controller 21. In such a state, the recording material P carrying the unfixed toner image t is introduced along the entrance guide 23 into the fixing nip 27. By the fixing nip 27, the recording material P is nipped a fed while the toner image carrying side of the recording material P is in contact with the outer surface of the fixing sleeve 20. The heat of the fixing heater 16 is applied to the recording material P through the fixing sleeve 20, and the unfixed toner image on the recording material P is heated and pressed so that it is fused and fixed. The recording material P having passed through the fixing nip 27 is separated by the curvature from the fixing sleeve 20 and is discharged by the fixing and sheet discharging roller 26.

[Fixing Heater 16]

Figure 14:
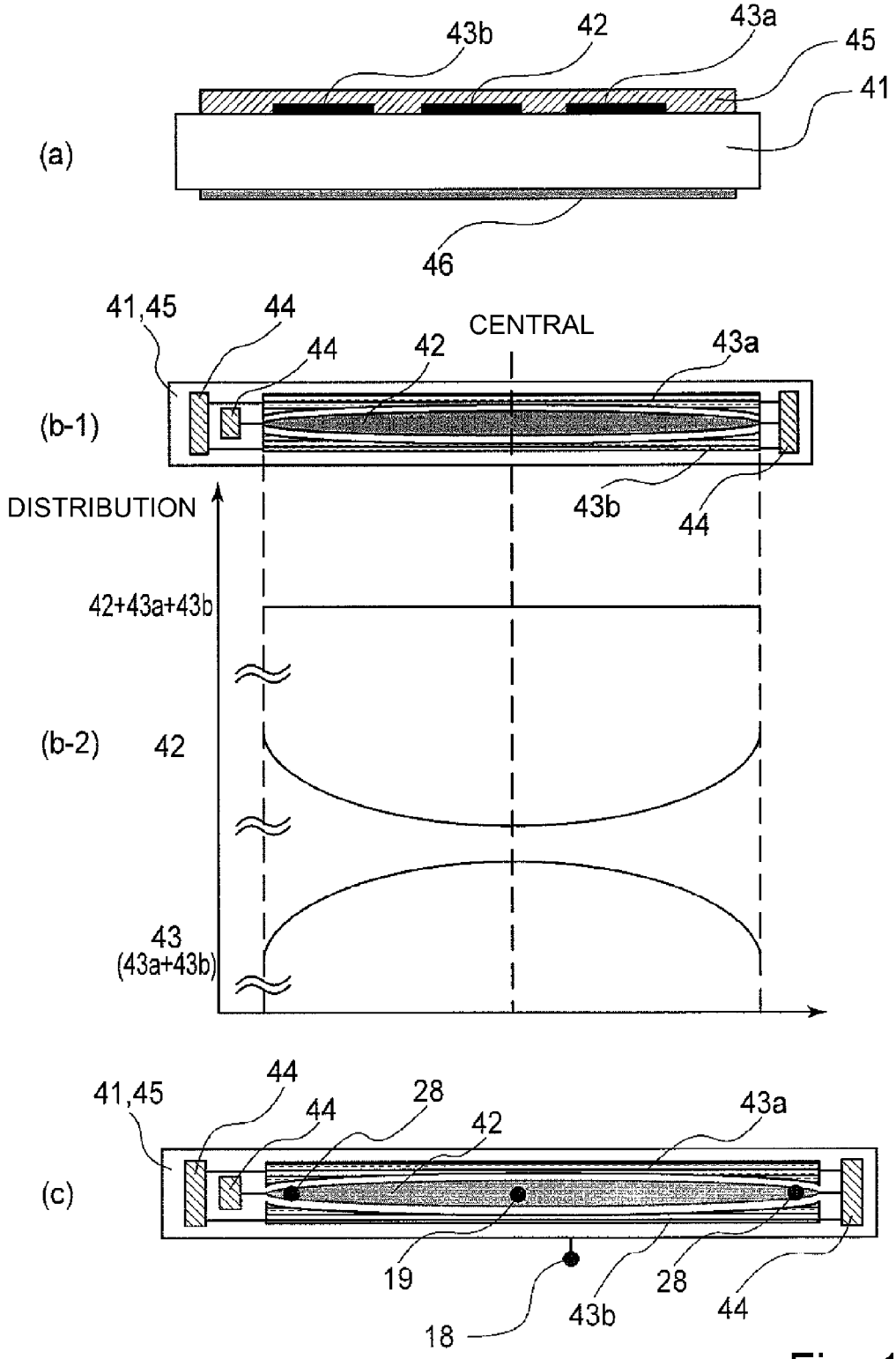
FIG. 14 is a graph showing a heat generation distribution of a fixing heater in Embodiment 7.

Part (a) of FIG. 14 is a sectional view of the fixing heater 16. The alumina substrate 41 is a ceramic substrate elongated in the direction perpendicular to the feeding direction of the recording material P. The heat generating resistor layers 42, 43 (43*a*, 43*b*) (electric heat generating resistance layer) (heat generating element) are heating elements each having a thickness of approx. 10 μm and a width of 1 mm, painted in the form of line or band extending in the longitudinal direction by screen printing. For the heat generating elements 42, 43, an electroconductive paste including silver-palladium (Ag/Pd) alloy which generates heat by current therethrough is printed on the alumina substrate 41. For the electrode portion 44 ((b) of FIG. 2), a silver paste is printed by screen printing or the like into a pattern on a front side of the alumina substrate 41 as an electric power supply pattern for the heat generating elements 42, 43. A glass coating 45 having a small thickness of approx. 60 μm is provided to protect the heat generating elements 42, 43 to assure the insulativeness. The sliding layer 46 of polyimide is provided on the side of the alumina substrate 41 contacting the fixing sleeve 20.

Part (b-1) of FIG. 14 shows a front side of the fixing heater 16, and part (b-2) FIG. 14 shows a heat generation distribution of the fixing heater 16. The heat generating element 42 has a resistance ratio, per unit length, of the end to the central portion with respect to the longitudinal direction of the heater, which is larger than that of the heat generating element 43. The heat generating element 43 (43*a*, 43*b*) continuously increases in its width from the longitudinally center portion, and therefore, the amount of heat generation gradually decreases from the longitudinally central region toward the end portion. On the other hand, the heat generating element 42 continuously decreases in its width from the longitudinally center portion toward the end portion, and therefore, the amount of heat generation gradually increases from the longitudinally central region toward the end portion. Thus, the amount of heat generation is changed continuously in the longitudinal direction so that the non-sheet-passage-part temperature rise (end portion temperature rise) can be effectively suppressed in a fixing device applicable for a wide variety of sheet size up to A4 size. The electrode portion 44 of the fixing heater 16 is provided with a electric energy supply connector, and the electric energy supply is effected to the electrode portion 44 through the electric energy supply connector from the heater driving circuit portion, by which the heat generating elements 42, 43 generates heat to quickly raise the temperature of the fixing heater 16. In the normal use, the rotation of the fixing sleeve 20 starts with the start of rotation of the pressing roller 22, so that with rise of the temperature of the fixing heater 16, the inner surface temperature of the fixing sleeve 20 rises. The controller 21 controls the electric power supply to the fixing heater 16 by a PID control so that the detected temperature of the sleeve thermister 18 ((b) of the FIG. 13) indicative of the inner surface temperature of the fixing sleeve 20 is the target value.

Part (c) of the FIG. 14 shows a positional relation between the fixing heater 16 and the thermister. In this embodiment, in order to detect the non-sheet-passage-part temperature rise at the time of the recording material having a width smaller than the maximum processable width is being fed, end thermistors 28 are provided at the opposite ends in addition to the sleeve thermister 18 and the main thermister 19. Here, the width of the recording material is a dimension of the recording material measured in the direction perpendicular to the feeding direction of the recording material. The sleeve thermister 18 for detecting the inner surface temperature of the fixing sleeve 20 is provided with a thermister element mounted to the free end of the arm 25 of stainless steel fixed to the heater holder 17 ((b) of the FIG. 13). By the elastic swing of the arm 25, the contact of the thermister element to the inner surface of the fixing sleeve 20 can be always assured even when the movement of the inner surface of the fixing sleeve 20 is unstable. The main thermister 19 contacts the neighborhood of the longitudinally center portion of the fixing heater 16 to detect the temperature of the back side of the fixing heater. The end thermister 28 is provided in the non-sheet-passage-part range with respect to the LTR size (landscape, width of 279 mm), so that the non-sheet-passage-part temperature can be detected at the time of the LTR size recording material being fed. In this embodiment, the controller 21 controls the electric power supply to the fixing heater 16 so that the detected temperature of the main thermister 19 maintains the set temperature, but when the detected temperature of the sleeve thermister 18 deviates from the target value, the set temperature to be compared with the detected temperature of the main thermister 19 is corrected.

[Fixing Sleeve 20]

In this embodiment, the fixing sleeve 20 comprises a cylindrical endless belt (belt base material) of SUS having a thickness of 30 μm, and a silicone rubber layer (elastic layer) having a thickness of approx. 300 μm. On the silicone rubber layer, a PFA resin material tube (outermost layer) having a thickness of 20 μm is provided. The thermal capacity of the fixing sleeve 20 was measured as 2.9×10-2 cal/cm$^2$·° C. per 1 cm$^2$ of fixing sleeve. The base layer of the fixing sleeve 20 may be of polyimide or the like, but SUS is better than polyimide in that the thermal conductivity is approx. 10 times, and therefore, the on-demand property is better. For the elastic layer of the fixing sleeve 20, a rubber layer exhibiting a high thermal conductivity is used in order to provide a high on-demand property, and the specific heat thereof is 2.9×10-1 cal/g·° C. On the surface of the fixing sleeve 20, a fluorinated resin material layer is provided, by which the parting property of the surface is improved, and the offset phenomenon—which results from the toner being deposited once onto the surface of the fixing sleeve 20 and then moving to the recording material P again can be prevented. Because the fluorinated resin material layer at the surface of the fixing sleeve 20 is in the form of a PFA tube, the fluorinated resin material layer can be easily made uniform.

Generally, with the increase of thermal capacity of the fixing sleeve 20, the temperature rising becomes dull with the result of deterioration of the on-demand property. For example, when it is supposed that in a device in which the heater is at rest during the stand-by period, and the temperature rises sufficiently within 1 minute from the print instructions without temperature control, it is necessary that the thermal capacity of the fixing sleeve 20 has to be not more than 1.0 cal/cm$^2$·° C. In this embodiment, the device is designed such that in the case that the voltage source is actuated a while after deactuation of the voltage source, the temperature of the fixing sleeve 20 is sufficiently heated up to 190° C. within 20 seconds from actuation of the electric power supply of 1000 W to the fixing heater 16. When the specific heat of the silicone rubber layer is approx. 2.9×10-1 cal/g·° C., the of the silicone rubber has to be not more than 500 μm, and it is necessary that the thermal capacity of the fixing sleeve 20 has to be not more than approx. 4.5×10-2 cal/cm$^{2}$·° C. On the contrary, if it is not more than 1.0×10-2 cal/cm$^{2}$·° C., the rubber layer of the fixing sleeve 20 is extremely thin, and the image quality such as OHT transparency and/or glossiness evenness results in being equivalent to that of an on-demand fixing device not provided with an elastic layer.

In this embodiment, the thickness of the silicone rubber necessary to provide a high image quality image of satisfactory OHT transparency and glossiness is not less than 200 μm, and in such a case, the thermal capacity is 2.1×10-2 cal/cm$^{2}$·° C. That is, generally, the thermal capacity of the fixing sleeve 20 is not less than 1.0×10-2 cal/cm$^{2}$·° C. and not more than 1.0 cal/cm$^{2}$·° C. In this range, in order to accomplish both of the on-demand property and the high image quality, the fixing sleeve of this embodiment is in range not less than 2.1×10-2 cal/cm$^{2}$·° C. and not more than 4.5×10-2 cal/cm$^{2}$·° C.

[Control of Throughput in this Embodiment]

The image forming apparatus of this embodiment is operable with two image forming speeds. The first image forming speed for a second small size paper printing mode (high speed small size sheet output mode) is approx. 150 mm/sec, and a second image forming speed for the first small size paper printing mode (normal small size sheet output mode) is lower than the first image forming speed, and is approx. ⅔ of that speed which is approx. 100 mm/sec. That is, in the second small size paper printing mode, the recording material feeding speed in the heating fixing portion is higher than that in the small size paper printing mode.

Figure 15:
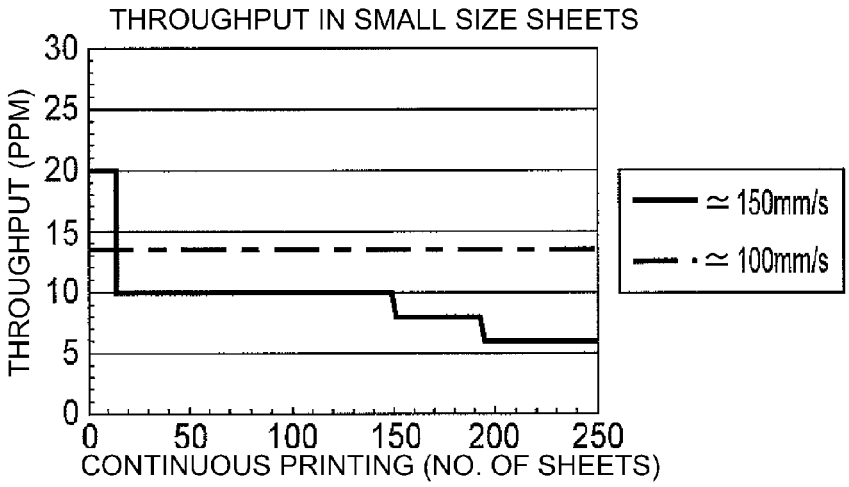
FIG. 15 is a graph and a Table showing average throughputs in a comparison example.
Figure 15:
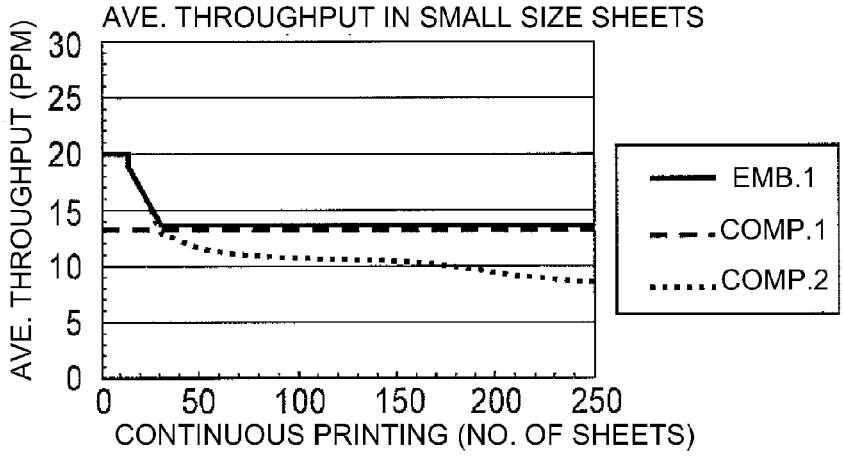

Part (a) of FIG. 15 is a graph showing a relation between the continuous print number and the throughput (ppm: number of prints per one minute), when small size sheets are fed under the low temperature ambient condition (approx. 15° C.) at the first image forming speed and the second image forming speed. The used small size sheet is Business Multipurpose white paper 4200 available from Xerox Corporation and has a letter-size (width of 216 mm×length of 279.4 mm) and a basis weight of approx. 90 g/m$^{2}$.

The fixing temperature in the case of first image forming speed (detected temperature of the sleeve thermister 18) is approx. 175° C. from the standpoint of the fixing property. When the sheet is passed at the first image forming speed, the speed is 20 ppm at the initial stage, and when approx. 15 sheets are processed, the detected temperature of the end thermister 28 reaches a throughput down threshold temperature (approx. 270° C., for example) due to the non-sheet-passage-part temperature rise. Then, the throughput is lowered from the 20 ppm down to 10 ppm (the image forming speed remains unchanged, that is, 150 mm/sec, but the sheet interval is expanded). Thereafter, the detected temperature of the end thermister 28 reaches the throughput down threshold again at approx. 150 sheets processed, and the throughput is lowered to 8 ppm from 10 ppm (the image forming speed remains unchanged, that is, 150 mm/sec, but the sheet interval is further expanded). Thereafter, the detected temperature of the end thermister 28 reaches the throughput down threshold again at approx. 193 sheets processed, and the throughput is lowered to 6 ppm from 8 ppm (the image forming speed remains unchanged, that is, 150 mm/sec, but the sheet interval is further expanded). As will be understood, when the image forming speed (fixing process speed) is fixed at the first image forming speed, the throughput (output number per unit time) gradually lowers if the print number is large.

The fixing temperature in the second image forming speed operation is approx. 155° C. which is lower than the fixing temperature setting in the first image forming speed operation since the image forming speed is lower than the first image forming speed. Therefore, the fixing speed is slow, and the fixing temperature per se is low, and therefore, the non-sheet-passage-part temperature rise is low, and when the sheet is fed at the second image forming speed, the initial speed is approx. 13.4 ppm, and thereafter, the end thermister 28 does not reach the throughput down threshold temperature.

In view of this, in this embodiment, if the required print number in the small size sheet print is not more than a predetermined number (continuously outputtable number), the mode is set to the second small size paper printing mode (image forming speed is fixed at the first speed), and the printing is executed, and when the print number is larger than the predetermined number, the mode is set to the first small size paper printing mode the image forming speed is fixed to the second speed), and the printing is executed.

Figure 17:
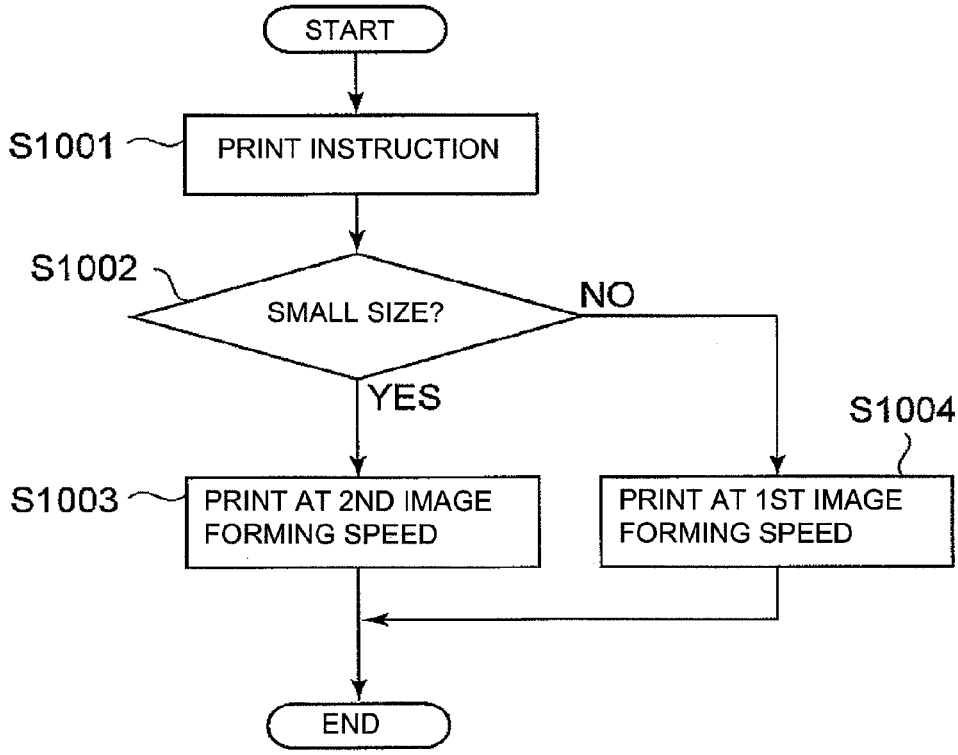
FIG. 17 is a flow chart showing processing in a comparison example.

FIG. 17 is a flow chart of throughput control in a comparison example. In the comparison example, when the print instructions is produced in step 1001 (S1001 or the like) and if the operation is not for small size sheet (S1002), the printing is executed at the first image forming speed (S1004). If the operation is for small size sheet (S1002), the printing is executed at the second image forming speed which is lower than the first image forming speed In the comparison example, the image forming speed is fixed corresponding to the passing paper size Part (b) of the FIG. 15 shows a average throughput at the time of small size sheet processing in this example as comparison example 1. In comparison example 1 wherein the speed is fixed to the second image forming speed, the initial average throughput is approx. 13.4 ppm, and the average throughput is approx. 13.4 ppm even if the print number is large.

Another comparison example was checked. Part (b) of the FIG. 15 is a graph of comparison example 2 in which the image forming speed for small size sheet processing is fixed to the first image forming speed, and the non-sheet-passage-part temperature rise is prevented by expanding the sheet intervals. In comparison example 2, the throughput is high, that is 20 ppm in the initial stage, but the when approx. 14 sheets are processed, the throughput lowers due to the non-sheet-passage-part temperature rise (the sheet intervals are expanded). Therefore, the average throughput lowers with increase of the number of prints.

Figure 16:
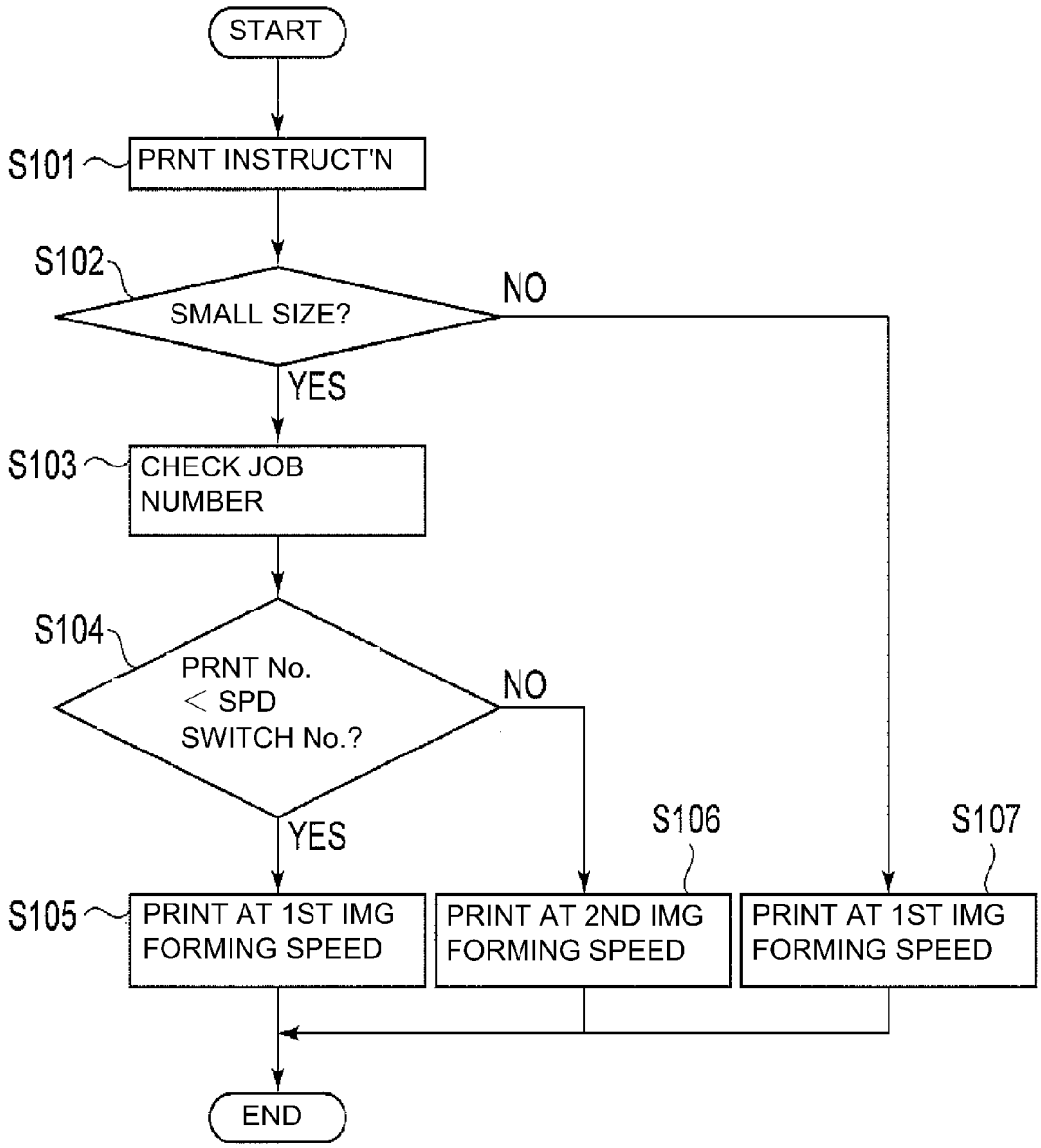
FIG. 16 is a flow chart showing processing in Embodiment 7.

FIG. 16 is a flow chart showing the throughput control in this embodiment. When the print instructions is produced in step S101, and the unshown engine controller discriminates that the sheet is not a small size sheet in step S102, the printing is executed at the first image forming speed in step S107, as is the same with the foregoing comparison example. If the engine controller discriminates in step S102 that the sheet size is smaller than a predetermined width, that is B5, A5, EXE, A4 longitudinal for example, the operation goes to S103. In step S103, the engine controller checks the print JOB number (number of image formations), and compares it with a predetermined image forming speed switching number in step S104. If, in step S104, the engine controller discriminates that the print JOB number is smaller than the predetermined number, that is, the image forming speed switching number, and the control is executed for the printing at the first image forming speed, in step S105. If, in step S104, the engine controller discriminates that the print JOB number is larger than the predetermined number, that is, the image forming speed switching number, the control is executed for the printing at the second image forming speed which is lower than the first image forming speed in step S106. The image forming speed switching number (predetermined number) is 30, for example.

Parts (b) and (c) of the FIG. 15 show the print JOB number and the average throughput at comparison examples 1, 2. By this embodiment, when the print JOB number is smaller than the image forming speed switching number (14 sheets), the printing is completed at 20 ppm, and therefore, the average throughput (average ppm) is larger than in comparison example 1. When the print JOB number is 15-30, the speed of 20 ppm with the speed 150 mm/sec is maintained in the period of printing the first 14 sheets. In the period of 15th to 30th sheets, the speed of 150 mm/sec is maintained, and the sheet intervals are expanded, and therefore, the output speed is 10 ppm, but the average throughput from the first to the end (not more than 30) is not less than 13.4 ppm. By this embodiment, the print JOB number is larger (100, 200) than the image forming speed switching number (30), the image forming speed is 100 mm/sec from the first print, and the fixing temperature is lower than in the case of 150 mm/sec of the image forming speed, and therefore, it is not necessary to expand the sheet intervals significantly, the average throughput from the first to the end is 13.4 ppm, and the average throughput (average ppm) is larger than in the comparison example 2.

As described in the foregoing, according to this embodiment, the image forming speed is switched in accordance with the number of print jobs, and therefore, the productivity (performance) in the case of small size sheet processing can be improved, and the lifetimes of the image forming station and the fixing device or the like can be expanded.

INDUSTRIAL APPLICABILITY

According to the present invention, when limited numbers of small size sheets are outputted at times, the throughput can be increased. This improves the practical operability. According to the present invention, it is unnecessary to change the hardware structure, and the information processing software change is enough, and therefore, the required cost is low.

The invention claimed is:

1. An image forming apparatus comprising:

an image forming portion for forming a toner image on a recording material; and a heating fixing portion for heating and fixing the toner image on the recording material, wherein for a printing on a small size sheet having a width smaller than a maximum processable width of said image forming apparatus, said apparatus is operable in a first small size sheet printing mode, in which a number of continuously printable sheets is not limited, and a second small size sheet printing mode in which a number of continuously printable sheets is limited and in which an output number per unit time is greater than that in the first small size sheet printing mode, wherein when a new printing command is inputted during execution of a current printing job in the first small size sheet printing mode, a new printing job is started after completion of the current printing job without a rest period, and wherein when a new printing command is inputted during execution of the current printing job in the second small size sheet printing mode, a new printing job is started after the completion of the current printing job, with a predetermined rest period between the completion of the current printing job and the start of the new printing job.

2. An apparatus according to claim 1, wherein in the second small size sheet printing mode, a recording material feeding speed in said heating fixing portion is higher than that in the first small size sheet printing mode.

3. An apparatus according to claim 2, wherein in the first small size sheet printing mode, a target temperature in a fixing process of said heating fixing portion is lower than that in the second small size sheet printing mode.

4. An apparatus according to claim 1, wherein said heating fixing portion includes a fixing film, a heater contacting an inner surface of said fixing film, and a pressing roller forming a fixing nip together with said heater through said fixing film.

5. An apparatus according to claim 1, wherein the first small size sheet printing mode and the second small size sheet printing mode are user selectable.

6. An apparatus according to claim 1, wherein selecting a mode from the first small size sheet printing mode and the second small size sheet printing mode is carried out in said image forming apparatus in accordance with a required print number.

7. An apparatus according to claim 1, wherein the first small size sheet printing mode is used with the output number per unit time being stepwisely decreased in accordance with a printing number.

* * * * *